US009868009B2

(12) United States Patent
Lagree et al.

(10) Patent No.: US 9,868,009 B2
(45) Date of Patent: Jan. 16, 2018

(54) EXERCISE MACHINE WITH VARIABLE RESISTANCE SYSTEM

(71) Applicant: Lagree Technologies, Inc., Burbank, CA (US)

(72) Inventors: Sebastien Anthony Louis Lagree, West Hollywood, CA (US); Matthew O'Brien, Gardena, CA (US); William Balzer, Gardena, CA (US)

(73) Assignee: Lagree Technologies, Inc., Burbank, CA (US)

( * ) Notice: Subject to any disclaimer, the term of this patent is extended or adjusted under 35 U.S.C. 154(b) by 16 days.

(21) Appl. No.: 14/840,630

(22) Filed: Aug. 31, 2015

(65) Prior Publication Data

US 2016/0059061 A1 Mar. 3, 2016

Related U.S. Application Data

(60) Provisional application No. 62/043,503, filed on Aug. 29, 2014.

(51) Int. Cl.
*A63B 21/00* (2006.01)
*A63B 21/012* (2006.01)
(Continued)

(52) U.S. Cl.
CPC .... *A63B 21/00065* (2013.01); *A63B 21/0059* (2015.10); *A63B 21/023* (2013.01);
(Continued)

(58) Field of Classification Search
CPC ..... A63B 21/00058; A63B 21/00065; A63B 21/00069; A63B 21/4031; A63B 21/154; A63B 21/155; A63B 21/156; A63B 21/157; A63B 22/20; A63B 22/201; A63B 22/203; A63B 22/0076; A63B 22/0087; A63B 24/0087; A63B 2022/0079; A63B 21/00072; A63B 21/151; A63B 21/152; A63B 21/153
See application file for complete search history.

(56) References Cited

U.S. PATENT DOCUMENTS 339,638 A 4/1886 Goldie
3,806,094 A 4/1974 Harken
(Continued)

OTHER PUBLICATIONS

PCT International Search Report and Written Opinion for PCT/US15/47746 from the Korean Intellectual Property Office; dated Nov. 19, 2015.

*Primary Examiner* — Nyca T Nguyen
(74) *Attorney, Agent, or Firm* — Neustel Law Offices

(57) ABSTRACT

The exercise machine with a variable resistance system includes a frame, an exercise implement movably connected to the frame, a main shaft rotatably connected to the frame, a main connector attached between the main shaft and the exercise implement, a plurality of resistance assemblies and a plurality of actuation assemblies adapted for selectively engaging or disengaging at least one of the plurality of resistance assemblies with respect to the main shaft. The plurality of resistance assemblies apply a total level of rotational resistance against the main shaft based on which of the plurality of resistance assemblies are engaged with the main shaft by the plurality of actuation assemblies.

17 Claims, 14 Drawing Sheets

(51) Int. Cl.

| | |
|---|---|
| ***A63B 21/015*** | (2006.01) |
| ***A63B 21/018*** | (2006.01) |
| ***A63B 21/02*** | (2006.01) |
| ***A63B 23/12*** | (2006.01) |
| ***A63B 24/00*** | (2006.01) |
| ***A63B 21/055*** | (2006.01) |
| ***A63B 22/20*** | (2006.01) |
| ***A63B 23/035*** | (2006.01) |
| ***A63B 21/04*** | (2006.01) |
| ***A63B 21/005*** | (2006.01) |

(52) U.S. Cl.

CPC ..... *A63B 21/0428* (2013.01); *A63B 21/0557* (2013.01); *A63B 21/154* (2013.01); *A63B 21/157* (2013.01); *A63B 21/4031* (2015.10); *A63B 21/4035* (2015.10); *A63B 22/203* (2013.01); *A63B 22/205* (2013.01); *A63B 23/03516* (2013.01); *A63B 23/12* (2013.01); *A63B 23/1263* (2013.01); *A63B 24/0087* (2013.01)

(56) References Cited

U.S. PATENT DOCUMENTS 5,316,535 A * 5/1994 Bradbury ..... A63B 23/1209 482/114
6,790,163 B1 9/2004 Van De Laarschot
6,929,589 B1 * 8/2005 Bruggemann ..... A63B 21/025 482/121
7,803,095 B1 9/2010 Lagree
7,871,359 B2 * 1/2011 Humble ..... A63B 21/025 242/375.1
7,878,955 B1 * 2/2011 Ehrlich ..... A63B 21/025 482/127
8,641,585 B2 2/2014 Lagree
2002/0025888 A1 * 2/2002 Germanton ..... A63B 21/063 482/1
2002/0025891 A1 * 2/2002 Colosky, Jr. ..... A63B 21/025 482/127
2003/0119635 A1 6/2003 Arbuckle
2004/0043873 A1 3/2004 Wilkinson
2005/0085351 A1 * 4/2005 Kissel ..... A63B 21/06 482/94
2006/0105889 A1 * 5/2006 Webb ..... A63B 21/0455 482/94
2008/0254952 A1 10/2008 Webb
2009/0023561 A1 * 1/2009 Ross ..... A63B 21/055 482/92
2010/0144499 A1 * 6/2010 Graham ..... A63B 21/055 482/131
2011/0039665 A1 2/2011 Dibble
2011/0166002 A1 7/2011 Savsek
2013/0150216 A1 * 6/2013 Bell ..... A63B 22/0076 482/72
2015/0329011 A1 * 11/2015 Kawai ..... B62M 7/02 701/22

* cited by examiner

EXERCISE MACHINE WITH VARIABLE RESISTANCE SYSTEM

CROSS REFERENCE TO RELATED APPLICATIONS

I hereby claim benefit under Title 35, United States Code, Section 119(e) of U.S. provisional patent application Ser. No. 62/043,503 filed Aug. 29, 2014. The 62/043,503 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an improved exercise machine and more specifically it relates to an exercise machine with variable resistance system for selecting one of many different resistance forces being applied to an exercise implement.

Description of the Related Art

Any discussion of the related art throughout the specification should in no way be considered as an admission that such related art is widely known or forms part of common general knowledge in the field.

Exercise is human physical activity that enhances or maintains overall physical health of an exerciser. Exercise is performed to increase muscle strength, improve balance, improve cardiovascular efficiency, and to aid in weight loss.

Cardiovascular exercises are intended to improve circulatory and respiratory performance and health by raising the heart rate for an extended period of time, increasing oxygenation and calorie burn. Within the fitness industry, cardiovascular exercise is often referred to as "cardio". Typical cardio exercise equipment found in gyms includes treadmills, stationary bikes, elliptical trainers, and stair climbers. Cardio exercises performed without the aid of specialized apparatuses include running and swimming.

Strength exercises are intended to increase the ability for muscles to perform more work. The exercises are practiced consistently over weeks or months. Strength exercises are typically performed in short but high intensity muscle bursts, rather than the long duration of cardio exercises. Strength training is intended to break down the muscles targeted by the exercise. The subsequent repair of muscle tissue after training is achieved by increased localized blood circulation that delivers nutrients and oxygen, both of which promote repair and growth of the muscle beyond its size and strength prior to exercise.

Strength exercise machines are apparatuses or devices providing for fixed or adjustable amounts of resistance, and which are used during physical activity to enhance the strength or conditioning effects of the performed exercises.

Myriad apparatuses have been made available by many manufacturers; each apparatus intended to work one targeted muscle or group of muscles. For instance, a bicep curl machine is intended to exercise only the bicep muscles, while a chest press machine is intended to primarily exercise the chest muscles, but to a lesser degree, shoulder and triceps muscles.

Strength exercise apparatuses may incorporate as the resistance source free weights, for example, barbells, dumbbells or stacked weights, resistance springs or bands, or position the exerciser so as to use the exerciser's own body weight as the weight resistance source.

Contemporary methods of exercising against a workload are many, and well known to those skilled in the art. One method of creating a direct vertical workload is an exerciser's application of force to lift a dead weight from a resting position to a higher vertical position. Another method of creating a horizontal workload is to redirect a vertical workload along a horizontal vector using a pulley or mechanical linkage. Yet another method of creating a workload in any direction is to apply a force opposite the force axis of a variable resistance means, such as a spring or elastic resistance band.

Still another method of creating a workload is to require a continuous cycle of lifting one's own body weight. For instance, a person exercising on a motorized treadmill is required to increase or decrease the elevation, through which they lift their body with each step, and/or to increase or decrease the speed or length of stride in order to maintain their relatively stationary position upon the moving treadmill belt. Increasing the pitch of the treadmill belt further causes the exerciser to increase their work by lifting their body weight higher with each step in order to maintain their position on a treadmill.

Those skilled in the art will recognize that most all exercise apparatuses provide for continuous or cyclical exercising in one primary direction. For instance, an bicep curl machine is operated by an exerciser repeatedly flexing their bicep to raise their lower arm against a prescribed weight, then by slowly releasing the bicep muscle flex, allows the re-extension of their lower arm to return the weight to the starting point, then repeat the cycle for a prescribed number of times.

On the other hand, a triceps apparatus works opposite to a bicep curl apparatus in that the primary work is performed by flexing the triceps to extend the forearm to substantially align with the upper arm while working against a weight or resistance. By slowly relaxing the triceps, the weight is returned to its starting point as the lower arm assumes a decreasing angle relative to the upper arm.

As can readily be understood in the foregoing descriptions, exercise machines are intended to deliver a workload in one direction only. The primary work cycle on a bicep machine is achieved when the hand working against the resistance approaches the shoulder, while the primary work cycle on a triceps machine is achieved when the hand working against the resistance moves away from the shoulder. Therefore, a bicep machine does not appreciably exercise triceps, and a triceps machine does not appreciably exercise the biceps.

Another form of exercise produces a mixed benefit of combining cardio and strength training. Known to those skilled in the art, circuit training is a form of exercise that requires the exerciser to continuously work against resistance for a prolonged period, as previously described in cardio exercises, yet also incorporates a routine of large number of exercises that are performed in a rapid sequence, without any appreciable rest between each exercise.

One variation of circuit training is sometimes referred to as interval training wherein the exerciser generally performs the same exercise for a period of specific duration, similar to cardio exercising, but varies the resistance level throughout the routine period to substantially increase the exerciser's workload for short duration, high intensity bursts, then decrease the workload during a moderate recovery period whereby the cardio exercise intensity is maintained until a subsequent burst. The exerciser repeats this high/low intensity cycle until the end of the training period.

A disadvantage of attempting to perform circuit or interval training on a variety of exercise apparatuses by immediately and without an appreciable rest period, moving from one apparatus for one exercise, to another apparatus for a subsequent exercise is that in a typical gym environment, there will be another exerciser already working out on the next apparatus in the sequence, forcing the circuit exerciser to wait until the apparatus is available. This breaks the intended benefits of the continuous cycle of circuit training.

Another disadvantage of performing circuit training using multiple apparatuses in sequence within a gym environment is that even if the next apparatus is vacant, the proper weight or resistance level must be re-set for each exerciser. In many instances, this is time consuming, confusing, and the proper weight setting cannot be readily determined. Again, the break in the circuit sequence reduces the intended advantages of the circuit training session.

A disadvantage of attempting to perform a variation of circuit training upon a single exercise apparatus is that an exerciser must stop the exercise routine, most often by having to dismount the apparatus in order to change the existing resistance settings to new settings. The exerciser then re-mounts the apparatus and re-establishes proper positioning before continuing a new exercise at the new resistance setting. However, after a short period of performing a first exercise, often merely a minute or two, the exerciser would have to again dismount and change the resistance settings for a second exercise—then repeat the entire process with many additional exercises included in the particular routine. It often takes more time to change the resistance settings than the period of time the exerciser will actually perform the new exercise at the new setting.

Those skilled in the art will recognize the illustrated exercise machine to be visually similar to a traditional exercise machine known to those in the Pilates industry, but will immediately understand the functional and commercial advantages of the present invention as previously unknown and unavailable on modern fitness machines or Pilates apparatuses.

Those skilled in the art of the Pilates Method of fitness will appreciate the attributes of exercising upon a Pilates apparatus, namely the ability to perform smooth movements that help build core muscles while increasing flexibility and balance. Pilates apparatuses can be simply described as a substantially rectangular base frame, two parallel tracks extending substantially the longitudinal dimension of the base frame and attached thereto, and a slidable exercise platform that rides along the parallel tracks. The slidable platform is attached to one end of the apparatus by one or more resistance springs. By attaching one or more bias members between the base frame and slidable platform, an exerciser can produce work by moving the carriage in a direction opposite the end to which the springs are attached. By attaching more springs between the frame and carriage, an exerciser may create quite large resistance loads against which to exercise.

By maintaining a relatively high resistance level during an exercise, then quickly attaching or detaching one or more springs prior to the next exercise, and continuing the process between exercises throughout the workout session, an exerciser may realize benefits similar to the cardio and strength training achieved with traditional circuit training.

It will be further appreciated by those skilled in the art that an exerciser would typically be required to stop their exercising, dismount the apparatus, mentally compute how many bias members of what resistance levels they would have to attach to achieve the resistance level that would be reasonable for the anticipated exercise. Then, the exerciser remounts the apparatus, tests the resistance level by performing the anticipated exercise. If the resistance level is too great or too small, they stop, dismount, and make any modifications to the resistance level by removing or attaching one or more springs.

This process is imprecise, and requires the exerciser to repeatedly mount and dismount the apparatus in order to establish the correct resistance setting. As can readily be seen in FIG. 1, the bias members are necessarily exposed to the exerciser so that one or more of the bias members may be attached or detached to the rollable platform. Whether located laterally to the parallel rails, between the parallel rails, or a combination of in between and laterally to the rails, the bias members create obstacles to safely mounting or dismounting the apparatus, and are inherently injury-causing. It is therefore well known to those skilled in the art that most injuries in Pilates occur during mounting or dismounting, so this process also increases the risk of injury.

Although one advantage of using a Pilates apparatus for a circuit-type of training is that the exerciser will never have to break their workout session by waiting for another exerciser to vacate the apparatus, the major disadvantage is that the exerciser must still stop their workout between exercises to make spring changes. With many apparatuses providing for six or more springs of different resistance levels, it is often confusing for an exerciser to determine the resistance level for their next exercise, and then add up one combination of two or more springs of various resistance levels to finally arrive at their intended resistance level. The break in the exercise routine allows the heart rate to drop, and a single confused exerciser typically holds up the progress of an entire Pilates class while they are trying to figure out their ideal spring tension.

Still further, since Pilates classes are comprised of an instructor teaching a series of exercisers to many exercisers performing the same exercise on their respective apparatuses, each time the class is instructed to perform a new exercise, the entire class stops exercising for as long as it takes the most inexperienced exerciser to determine their proper resistance level for the exercise. This is disruptive for the class, the delays thereby causing the class time to run over the allotted time period in order to complete the full allotted exercising time. Contemporary Pilates apparatuses therefore increase the likelihood of injury, and are exceedingly difficult for an exerciser to determine the proper resistance levels and quickly make corrections without class disruption, all of which are commercially detrimental to the operations of the gym or Pilates studio.

Owners of gyms and Pilates studios know well that when classes are delayed, the class must either run longer than scheduled to make up for workout time, or have to stop at the scheduled time, disadvantaging other exercisers by limiting the workout time they have had during the period. Delays disrupt the classes; cause the exercisers to become frustrated, and ultimately limiting the number of classes that can be conducted during the day resulting in lost revenues for the gym or studio.

As can readily be seen in the immediately preceding example, the necessity of stopping the interval routine to dismount the apparatus to change resistance settings breaks the work cycle, thereby significantly diminishing the intended benefits of the interval training.

Still another disadvantage of all of the exercise machines and Pilates apparatuses just described is that the resistance is unidirectional. In other words, none of the machines provide for an exerciser to immediately change the direction of the resistance force.

As an example, the rotating belt of a motorized treadmill is intended to move such that an exerciser, facing the front of the machine, can walk or run at different speeds, on a flat, or "uphill". Reversing the rotation of the rotating belt would require the exerciser to begin walking or running backwards, and possibly "downhill". Not only would this be an unnatural exercise, reversing a treadmill belt during exercise would be dangerous, and would likely be the source of many injuries.

As another example, a pull down machine to exercise the latissimus dorsi muscles provides a seat upon which an exerciser sits, and an overhead bar attached to a cable. The cable is threaded through a pulley on the machine, and is attached to weights. When an exerciser pulls down the overhead bar to work the latissimus dorsi or back muscles, the downward direction of their pull is reversed through the pulley, and they are actually pulling the weights that are attached to the cable upward from the floor. On the other hand, there is no provision to allow the exerciser to switch resistance direction so they can push upward on the bar and lift the weights to exercise the shoulders as would be provided by a shoulder press machine. Pushing upward provides no work resistance.

Those skilled in the art will immediately recognize the deficiencies just described, and will understand that a sufficiently large number of machines to allow exercising of each major muscle group housing many machines requires leasing a large and expansive area for a functional gym or Pilates studio. They will appreciate that one machine capable of providing resistance for a wide variety of exercises allows for more economically efficient operations.

Further, fitness experts and gym operations will appreciate the commercial advantages of a new and improved exercise apparatus that provides for immediate and precise changing of the resistance level without considerable interruption to a workout routine, and a system of immediately reversing the direction of resistance to increase the number of muscles and muscle groups that may be exercised without dismounting the apparatus, thereby obviating the need to make complicated changeovers to the apparatus, or to move to another machine to perform a different exercise.

Because of the inherent problems with the related art, there is a need for a new and improved exercise machine with variable resistance system for selecting one of many predetermined exercise resistance forces being applied to an exercise implement.

BRIEF SUMMARY OF THE INVENTION

Provided herein is an exercise machine with variable resistance system which includes a frame, a variable resistance system connected to the frame, and an exercise implement connected to the variable resistance system. The resistance level of the variable resistance system is selected by an exerciser by manipulating the variable resistance system from a first indexed resistance level (e.g. 0 lbs, 5 lbs, 10 lbs, etc.) to a second indexed resistance level (e.g. 0 lbs, 5 lbs, 10 lbs, 15 lbs, etc.) via manual or automatic rotation of an actuation shaft. The resistance level may be increased or decreased by the exerciser to achieve the desired level of resistance force applied to the exercise implement.

Therefore, one exemplary embodiment of the present invention is a variable resistance system of an improved exercise machine comprising at least a movable exercise implement used for inputting an exercise force, a plurality of bias members or weights that counteract the exercise force, and a plurality of resistance assemblies and actuation assemblies therebetween providing for the conversion of an exerciser's inputted force along a vector to user-selectable increments of output force to be applied against none, or one or more of the resistance springs.

Another exemplary embodiment of the present invention is an assembly of a plurality of operably connected resistance assemblies; each comprising a force outputting resistance pulley with a rim groove, a cable with a first end affixed to the pulley, the cable wrapping substantially one circumference about the pulley rim, and a second end affixed to a spring yoke, one spline hub and collar selectively engageable with the pulley, the collar affixed to a single splined main shaft common for all cartridges, and a control rod controlling the position of a shift member responsive to a cam-grooved shift device (shift device), all of the shift devices being affixed to a single actuation shaft, each shift member thereby moving its respective collar to engage or disengage the pulley.

Another exemplary embodiment of the present invention is an improved exercise machine having a main connection assembly comprising a gear reduction system of a predetermined ratio to limit the rotation of a force output shaft and a plurality of output pulleys to one revolution regardless of where an exerciser positions the exercise force inputting component within the allowable range of motion of the force inputting component.

Yet another exemplary embodiment of the present invention is an improved exercise apparatus comprising an assembly of a plurality of operably connected shift devices, each shift device providing for a control rod positionable by means of engaging a cam-grooved shift device, and the plurality of cam-grooved shift devices affixed to a single actuation shaft. One or more of the shift devices provide for different pitches in the cam groove geometry so that the control rods cause synchronous or non-synchronous engagement of one or more of the output pulleys depending on the radial positioning of the selector shaft.

Another exemplary embodiment of the present invention is an improved exercise machine comprising an assembly of a plurality of actuation assemblies affixed to a single actuation shaft, each of the actuation assemblies incorporating a shift device cam groove different from one or more of the other actuation assemblies, and the output cables of each of the actuation assemblies being affixed to one or more bias members of varying K factor corresponding to the different resistance forces of each bias member. The rotation of the actuation shaft to each of many positions causes different collars to engage different output pulleys which are attached to different resistance forces, thereby providing for fast and simple selection of a desired exercise force by an exerciser.

Still another exemplary embodiment of the present invention is an improved exercise apparatus providing for the indirect connection of any number of available exercise bias members to one or more moveable exercise force input components through a user selectable variable resistance system.

These and other embodiments will become known to those skilled in the art, especially after recognizing the commercial and fitness training advantages of the exercising apparatus that provides for fast selection of specific resistance levels by a single inputting means, and that further provides for immediate reversing of the of the direction of the applied resistance force to thereby allow the reversing of the direction of the applied exercise force.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
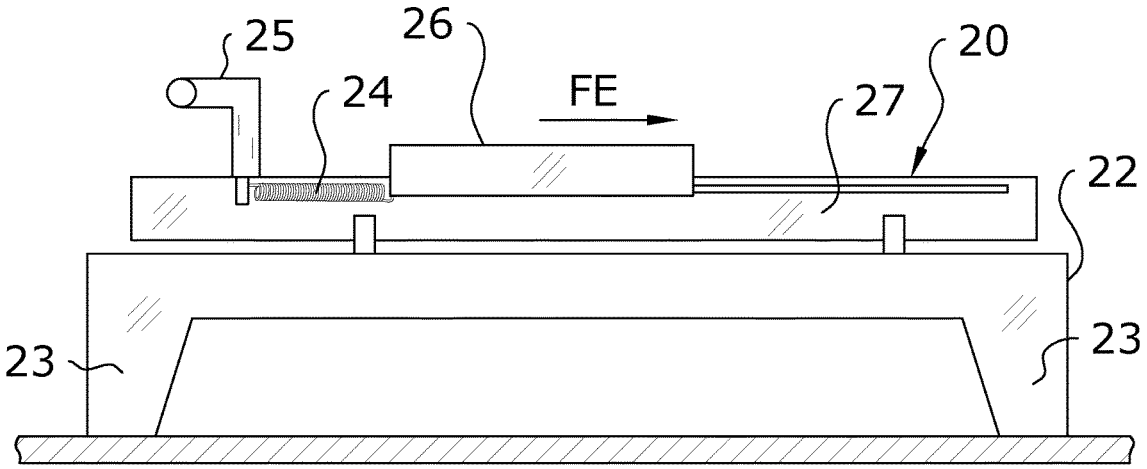
FIG. 1 (PRIOR ART)
FIG. 1 is an upper perspective view of a prior art exercise machine.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

Provided herein is an exercise machine with variable resistance system 10 which includes a frame 22, a variable resistance system connected to the frame 22 and an exercise implement 26 connected to the variable resistance system. The variable resistance system is comprised of a plurality of individually engageable resistance devices 34. The user selects the level of resistance they want applied to the exercise implement 26 and the corresponding resistance devices 34 are engaged to provide the selected level of resistance with the remaining resistance devices 34 disengaged. When one or more resistance devices 34 are engaged, the engaged resistance devices 34 are mechanically connected to the exercise implement 26 to provide the selected resistance level to the exercise implement 26. The resistance level of the variable resistance system is selected by an exerciser by manipulating the variable resistance system from a first indexed resistance level (e.g. 0 lbs 5 lbs 10 lbs) to a second indexed resistance level (e.g. 0 lbs, 5 lbs, 10 lbs, 15 lbs, etc.) via manual or automatic rotation of an actuation shaft 51. The resistance level may be increased or decreased by the exerciser to achieve the desired level of resistance force applied to the exercise implement 26.

The resistance devices 34 may each provide the same level of resistance force (e.g. 5 lbs, 10 lbs, 15 lbs) or different levels of resistance force. For example, each of the individually engageable resistance devices 34 may provide 5 lbs of resistance force thereby allowing the resistance level applied to the exercise implement 26 to be adjusted in 5 lb increments. As a further example, if a total combined resistance level of 20 lbs is selected and each of the resistance devices provides 5 lbs resistance force each, four resistance devices 34 will be engaged to be connected to the exercise implement 26 to provide a total resistance level of 20 lbs with the remaining resistance devices 34 disengaged and not connected to the exercise implement 26. If the user selects 25 lbs, then a fifth resistance device 34 is added for a total resistance level of 25 lbs. If the user selects 15 lbs, then one of the resistance devices 34 is disengaged or a total of three resistance devices 34 engaged totaling 15 lbs for a total resistance output.

It can be appreciated that the resistance devices 34 may have different resistance forces. For example, a first resistance device 34*a* may have 5 lbs resistance force, a second resistance device 34*b* may have 10 lbs resistance force, a third resistance device 34*c* may have 15 lbs resistance force and a fourth resistance device 34*d* may have 20 lbs resistance force. Various combinations of these different resistance devices 34 may be engaged and disengaged to achieve a desired level of resistance force upon the exercise implement 26. For example, if a user wanted to have a total of 40 lbs resistance force, the variable resistance system would engage the first, third and fourth resistance devices 34*a, c,*

*d* described previously to achieve a total of 40 lbs resistance force applied to the exercise implement 26.

In addition, the resistance force provided by each of the resistance devices 34 may be constant throughout the motion of the exercise implement 26 or may be varying based upon the position of the exercise implement 26 with respect to the frame 22. For example, if three resistance devices 34*a, b, c* are engaged and each resistance device 34*a, b, c* provides 5 lbs constant resistance force, then the total resistance force provided by the variable resistance system is 15 lbs throughout the entire range of motion of the exercise implement 26. As another example, if three resistance devices 34*a, b, c* are engaged and each resistance device 34*a, b, c* provides a varying resistance force (e.g. 2 lbs at an initial position of the exercise implement 26 and 6 lbs at a final position of the exercise implement 26), the total combined resistance force applied to the exercise implement 26 will correspondingly change based upon the position of the exercise implement 26.

Turning now descriptively to the drawings, in which similar reference characters denote similar elements throughout the several views, FIGS. 2 through 14 illustrate an exercise machine with variable resistance system 10 which comprises a frame 22, an exercise implement 26 movably connected to the frame, a main shaft 30 rotatably connected to the frame 22, a main connector 60 attached between the main shaft 30 and the exercise implement 26, a plurality of resistance assemblies 33, and a plurality of actuation assemblies 50, wherein each of the plurality of actuation assemblies 50 are adapted for selectively engaging or disengaging at least one of the plurality of resistance assemblies 33 with respect to the main shaft 30. The plurality of resistance assemblies 33 apply a total level of rotational resistance against the main shaft 30 based on which of the plurality of resistance assemblies 33 are engaged with the main shaft 30 by the plurality of actuation assemblies 50. Each of the plurality of resistance assemblies 33 includes a bias member 39 adapted to exert a resistance force against rotation of the main shaft 30 in a first rotational direction, wherein each of the plurality of resistance assemblies 33 is selectively engaged with the main shaft 30 or disengaged with the main shaft 30.

Figure 13:
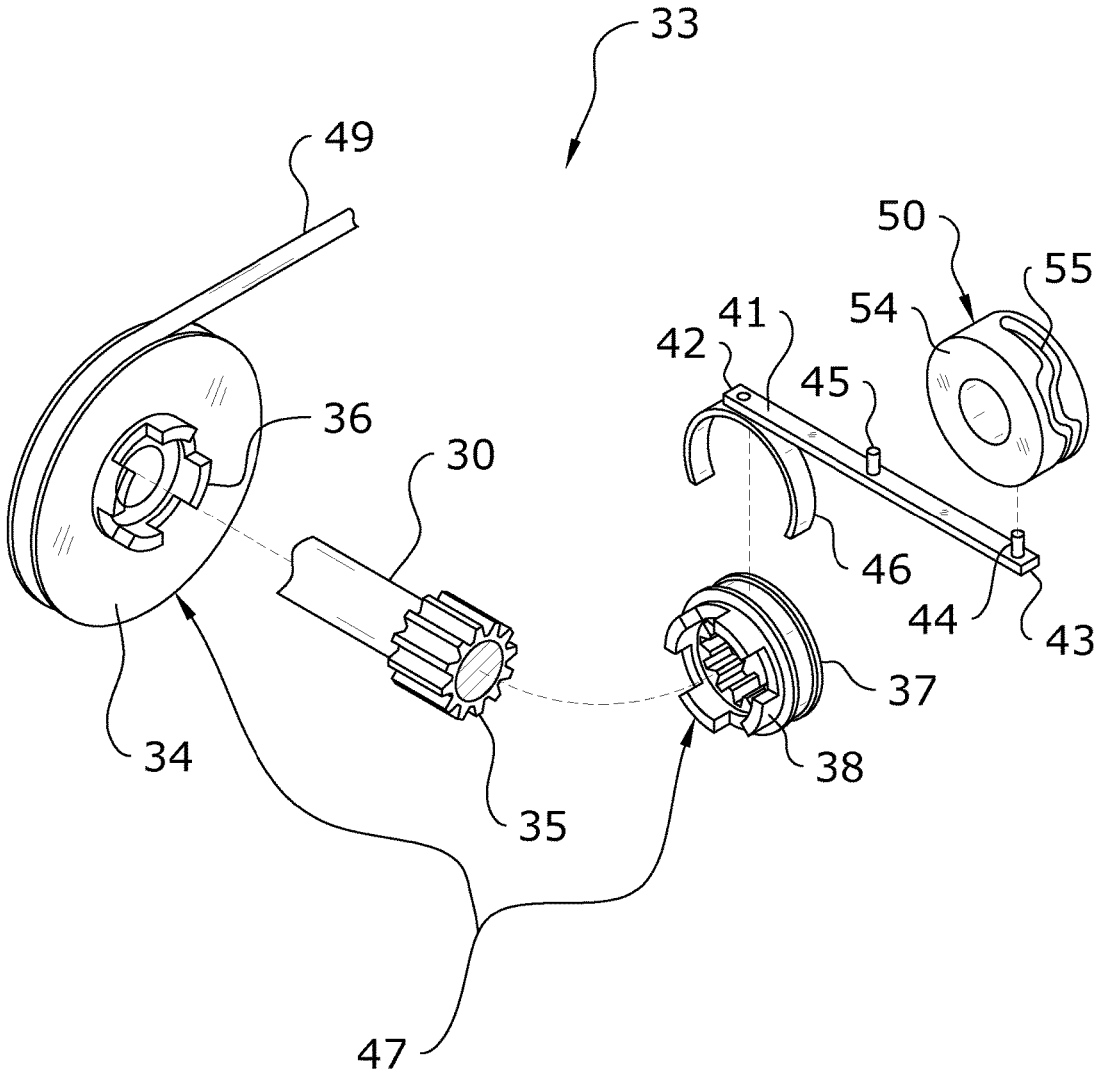
FIG. 13 is a lower exploded perspective view of a single actuation assembly and corresponding resistance assembly in one embodiment of the present invention.

Each of the plurality of resistance assemblies 33 preferably includes a clutch 47 for selectively engaging or disengaging each of the plurality of resistance assemblies 33 with respect to the main shaft 30. The clutch 47 is engaged or disengaged by one of the plurality of actuation assemblies 50. Each of the plurality of resistance assemblies 33 further preferably includes a pulley 34 rotatably positioned upon the main shaft 30 wherein the pulley 34 is connected to the bias member 39 as illustrated in FIG. 13 of the drawings. The clutch 47 selectively engages the pulley 34 to selectively lock or unlock the pulley 34 with respect to the main shaft 30. The pulley 34 is connected to the main shaft 30 in a non-rotating manner with respect to main shaft 30 when the pulley 34 is in a locked state with respect to the main shaft 30. The pulley 34 is not connected to the main shaft 30 so as to allow for free rotation of the pulley 34 with respect to the main shaft 30 when the pulley 34 is in an unlocked state with respect to the main shaft 30. The pulley 34 is selectively engaged or disengaged with the main shaft 30 by the clutch 47 to adjust the total level of rotational resistance against the main shaft 30.

The clutch 47 is preferably comprised of a non-slip clutch 47 to prevent slippage after engagement of the clutch 47 thereby providing the exact amount of resistance from the bias member 39 directly to the main shaft 30. For example, the clutch 47 may be a dog clutch having a plurality of interlocking teeth 36, 38.

Each of the plurality of actuation assemblies 50 includes a shift member 41 that is connected to the clutch 47 for engaging or disengaging the clutch 47. The shift member 41 is preferably comprised of an elongated member, wherein the shift member 41 includes a first end 42 connected one of the plurality of resistance assemblies 33 and an opposite second end 43 connected to one of the plurality of actuation assemblies 33.

Figure 14:
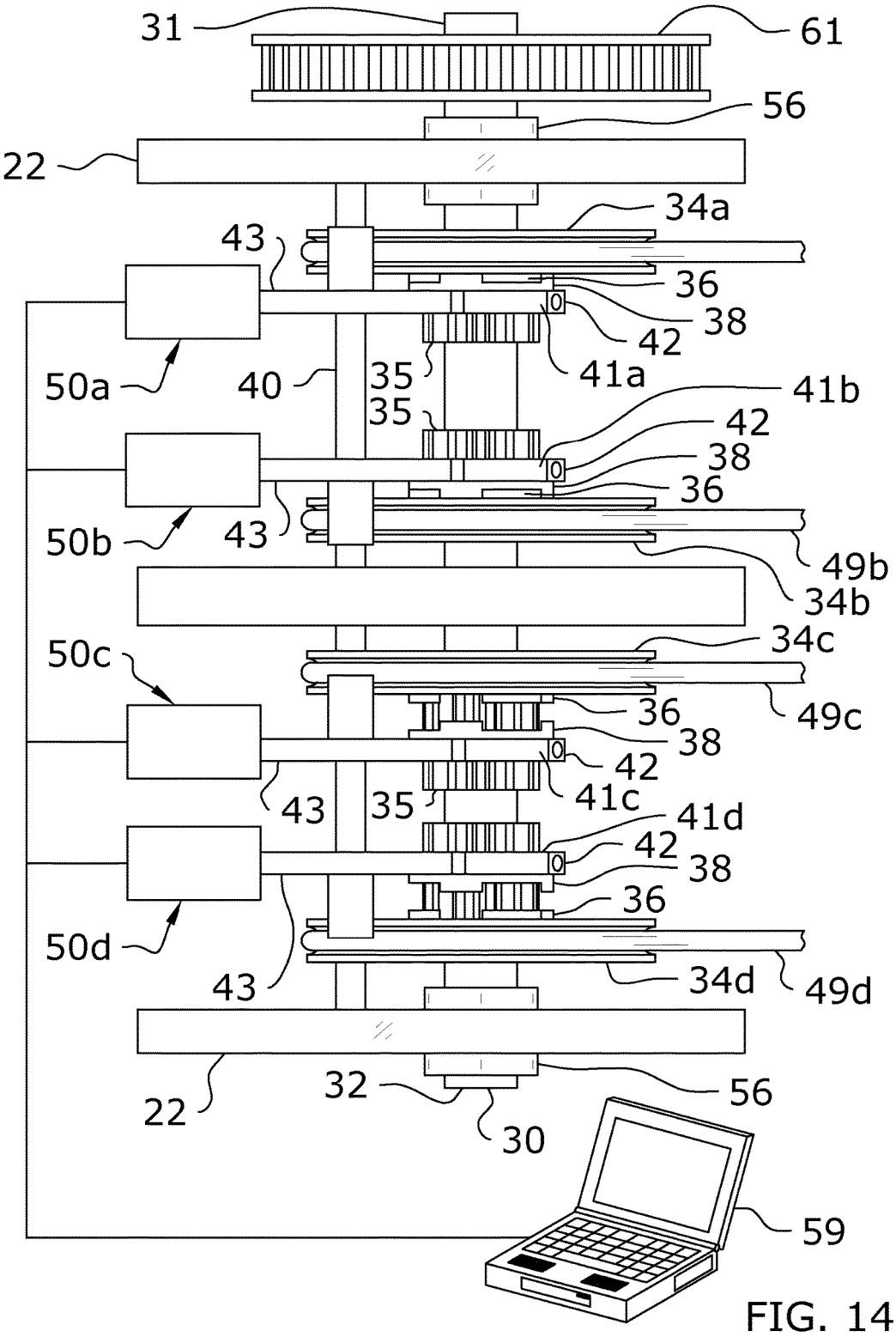
FIG. 14 is a top view of an alternative embodiment with the plurality of actuation assemblies comprised of an individually controllable actuator such as an electric actuator.

Each of the plurality of actuation assemblies 33 preferably includes a shift device 54 attached to an actuation shaft 51, wherein the second end 43 of the shift member 41 engages the shift device 54. The shift device 54 includes a cam groove 55 that is engaged by the second end 43 of the shift member 41. The cam groove 55 manipulates the position of the shift member 41 into either an engaged position for engaging the clutch 47 or a disengaged position for disengaging the clutch 47. A handle 57 or motor 58 (e.g. electric motor) is connected to the actuation shaft 51 for rotating the actuation shaft 51 and the corresponding shift devices 54. Each of the plurality of actuation assemblies 50 may alternatively be comprised of an electric actuator that individually controls the engagement state of a corresponding clutch as illustrated in FIG. 14 of the drawings.

The figures further illustrate in one embodiment of the invention a frame 22, an exercise implement 26 movably connected to the frame 22, and a main connection assembly 60 connected to the exercise implement 26. A main shaft 30 is rotatably connected to the frame 22, with the main shaft 30 being connected to the main connection assembly 60 such that resistance applied to the main shaft 30 is transferred to resist movement of the exercise implement 26. A plurality of resistance assemblies 33 are provided which may be adjusted with use of a plurality of actuation assemblies 50 to select a wide range of resistance increments to be applied to the exercise implement. Although the figures illustrate four resistance assemblies 33, separately identified as 33*a*, 33*b*, 33*c*, and 33*d*, it should be appreciated that more or less resistance assemblies 33 may be utilized. Similarly, although the figures illustrate four actuation assemblies 50, separately identified as 50*a*, 50*b*, 50*c*, and 50*d*, more or less actuation assemblies 50 may be utilized.

The resistance assemblies 33 of the present invention will each generally include a bias member 39 adapted to exert resistance against rotation of the main shaft 30 in a first rotational direction, with the resistance assemblies 33 being selectively engaged with the main shaft 30 to apply resistance or disengaged with the main shaft 30 to not apply any resistance. The figures illustrate four bias members 39 separately identified as 39*a*, 39*b*, 39*c*, and 39*d*, though more or less bias members 39 may be utilized. The bias members 39 of the resistance assemblies 33 are each connected to (such as by a wound cable) or directly connected around a resistance pulley 34, with the resistance pulley 34 being connected around the main shaft 30.

Each of the resistance pulleys 34 of the present invention is adapted to be selectively engaged or disengaged with the main shaft 30 by one of a plurality of collars 37. Although the figures illustrate four resistance pulleys 34, separately identified as 34*a*, 34*b*, 34*c*, and 34*d*, it should be appreciated that more or less resistance pulleys 34 may be utilized. Similarly, the figures illustrate four collars 37, separately identified as 37*a*, 37*b*, 37*c*, and 37*d*, but more or less collars 37 may be utilized.

The selective engagement or disengagement of the resistance pulleys 34 with the main shaft 30 will result in adjustment of the rotational resistance of the main shaft 34 which is dependent both on the number of engaged resistance pulleys 34 and the resistances of the bias members 39 utilized on each of the resistance pulleys 34. The resistance pulleys 34 rotate with the main shaft 30 when engaged with one of the collars 37 and do not rotate with the main shaft 30 when disengaged with one of the collars 37. The resistance pulleys 34 and collars 37 may be engaged by various methods, including the use of first teeth 36 on the resistance pulleys 34 and second teeth 38 on the collars 37, with the first teeth 36 being adapted to interlock with the second teeth 38.

The actuation assemblies 50 are operable to selectively engage or disengage the collars 37 with the resistance pulleys 34 to adjust which of the resistance assemblies 33 apply resistance to the exercise implement 26 via the main connection assembly 60. Such resistance adjustment is accomplished by virtue of the actuation assemblies 50 selective engaging or disengaging the resistance assemblies 33 with the main shaft 30. In a preferred embodiment, the actuation assemblies 50 comprise a plurality of shift devices 54 which are adapted to rotate with the actuation shaft 51. The figures illustrate four shift devices 54, separately identified as 54*a*, 54*b*, 54*c*, and 54*d*, though more or less shift devices 54 may be utilized. Each of the shift devices 54 includes a cam groove 55, with each cam groove 55 comprising a unique shape in some embodiments of the present invention. The figures illustrate four cam grooves 55, separately identified as 55*a*, 55*b*, 55*c*, and 55*d*, though more or less cam grooves 55 may be utilized.

The actuation assemblies 50 are connected to an actuation shaft 51 such that the actuation assemblies 50 rotate with the actuation shaft 51. The actuation shaft 51 may be rotatably connected to the frame 22, with the actuaion shaft 51 being rotatable either manually, such as by a selector handle 57, or automatically, such as by a motor 58 and control unit 59. In some embodiments, the actuation shaft 51 may extend parallel with respect to the main shaft 30. The present invention will thus apply a varying level of rotational resistance against the main shaft 30 based on the number of resistance assemblies 33 which are engaged with the main shaft 30.

The present invention may also include a plurality of shift members 41, each of which connect one of the plurality of shift devices 54 with one of the plurality of collars 37. The figures illustrate four shift members 41, separately identified as 41*a*, 41*b*, 41*c*, and 41*d*, though more or less shift members 41 may be utilized. The rotation of the shift devices 54 will move the shift members 41 such that the collars 37 engage or disengage with the resistance pulleys 34. The movement of the shift members 41 may vary in different embodiments and may include, by way of example, pivoting or sliding.

In a preferred embodiment, rotational resistance applied to the main shaft 30 is transferred into linear resistance of the exercise implement 26 by a main connection assembly 60. The main connection assembly 60 may comprise various configurations. In the embodiment shown in the figures, the main connection assembly 60 comprises an output pulley 64 connected to the main pulley 61 by a first drive belt 62 and a drive pulley 66 connected to the output pulley 64 by a drive shaft 65. Rotation of the main pulley 61 is imparted to the output pulley 64 by the drive pulley 66, the first drive belt 62, and said drive shaft 65. An idler pulley 68 is positioned a distance from the drive pulley 66 along the length of the exercise machine 20 and is connected to the drive pulley 66 by a second drive belt 67. The exercise implement 26 is adapted to move with the second drive belt 67, such as by being connected thereto by an implement connector 29.

Figure 11:
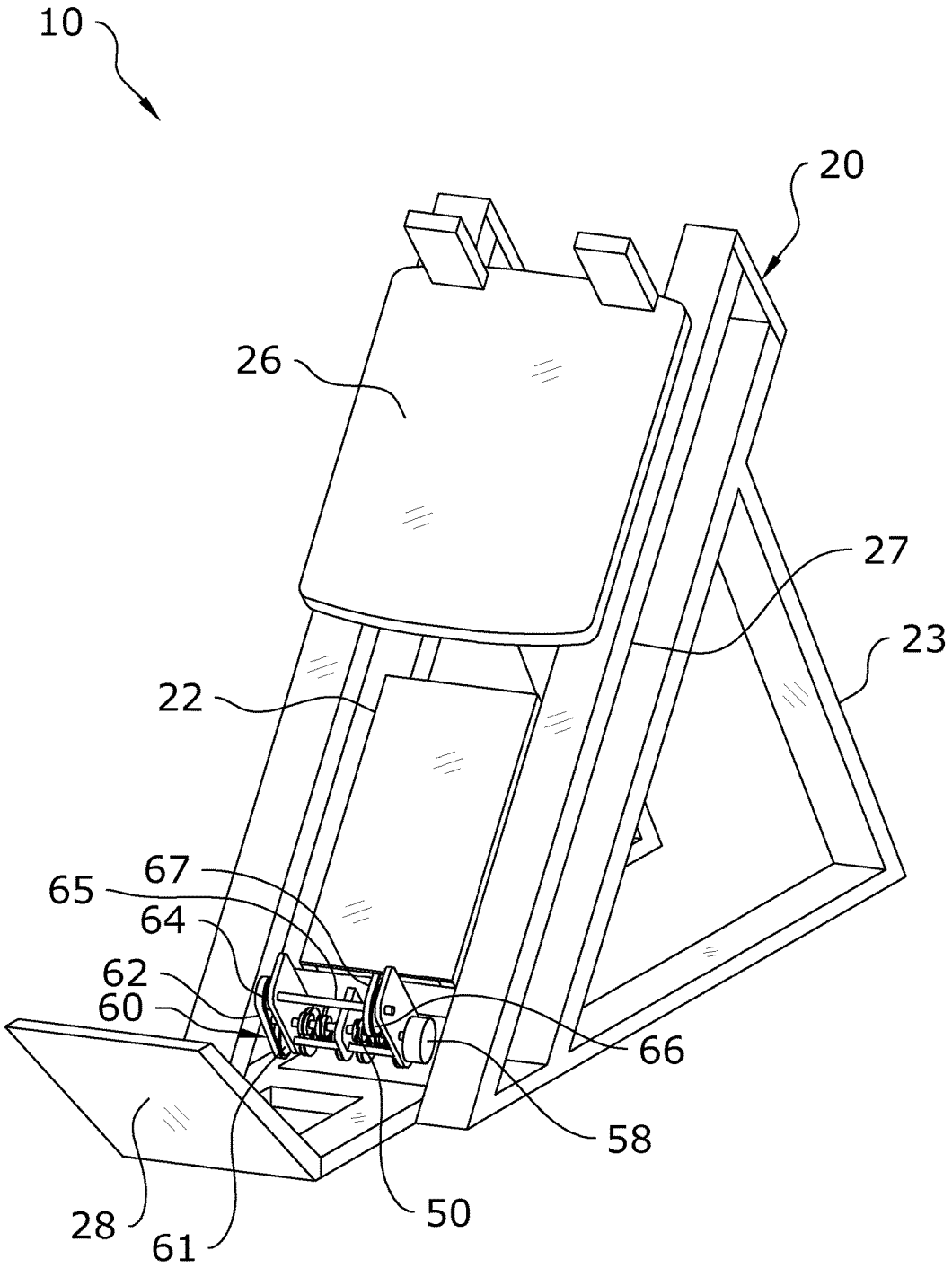
FIG. 11 is an upper perspective view of an alternate embodiment of the present invention in which the exercise machine comprises a squat machine.
Figure 12:
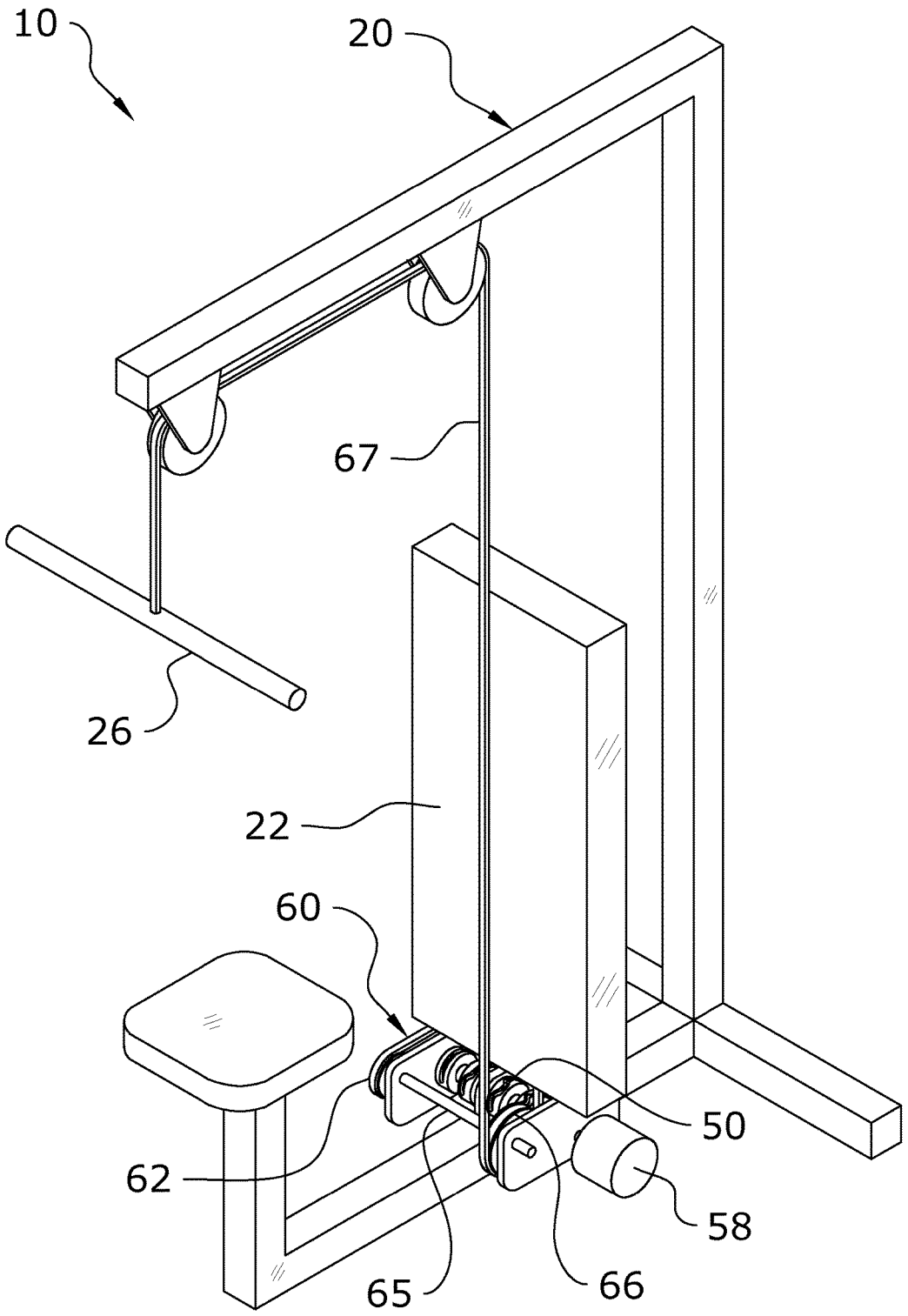
FIG. 12 is an upper perspective view of an alternate embodiment of the present invention in which the exercise machine comprises a lifting machine.

FIG. 1 is an exemplary diagram showing a side view of a traditional exercise machine 20, commonly referred to as a Pilates machine having a sliding carriage that reciprocates between a first end and a second end of the exercise machine. The preferred embodiment of the present invention is used with a Pilates machine. It should be noted that, while this figure merely illustrates a conventional exercise machine 20 comprising a Pilates machine, the improvements described herein may equally be applied to any number of exercise machines 20 which utilize an exercise implement 26 and exercise bias members 24, such as rowing machines, weight lifting machines, universal exercise machines, press machines, squat machines, dip machines, elliptical trainers, and the like. Thus, the present invention should not be construed as being limited to any particular type of exercise machine 20 or exercise implement 26. By way of example, FIG. 11 illustrates the present invention being utilized in combination with a squat machine rather than the Pilates machine shown in the other figures. As an additional example, FIG. 12 illustrates the present invention being utilized in combination with a lifting machine.

In the drawing, a frame 22 of a length substantially exceeding its width is positioned upon a floor, platform, or other ground surface, such as within a room containing fitness equipment. Two rails 27 are affixed to the frame by support cross braces, although the rails 27 may be attached to the frame 22 at the opposed ends, or at any point along the length so long as the rails 27 are solidly secured to the frame 22. An exercise implement 26 is affixed to the rails 27, typically by retaining wheels that are affixed to the exercise implement 26 within channels in or on the rails 27 so that an exerciser positioned upon the exercise implement 26 may move the exercise implement 26 towards either end of the parallel rails 27 in response to exercise forces applied to the exercise implement 26. For instance, an exerciser laying face-up upon the exercise implement 26 with their knees bent, and feet positioned on the push handles 25 would extend their feet, thereby pushing the exercise implement 27 towards the end of the exercise machine 20 opposite of the end to which the push handles 25 are attached.

Further, a plurality of exercise bias members 24 are made available for the exerciser to attach between the frame 22 and the exercise implement 26. Before an exercise, the exerciser must attach one or more exercise bias members 24 to the exercise implement 26, thereby creating a resistance force against which the exerciser will perform work. If an exerciser were to attach one exercise bias member 24 with a resistance level of ten pounds, the force they would exert upon the exercise implement 26 would be at least ten pounds in order to move the exercise implement 26 away from the handle 25 end of the exercise machine 20. It should be noted that a beneficial modification to the application of resistance to the exercise implement 26 as just described is to impart a minimal preload force, thereby reducing or eliminating slack in the system when the exercise implement 26 is fully retracted.

Ten pounds of exercise force applied to the exercise implement 26 in the direction shown FE would be reasonable for a small exerciser performing arm exercises. However, if a large, strong exerciser were to exercise their legs while lying face-up on the exercise implement 26 in the example just described, they would need to attach a great many exercise bias members 24 between the frame 22 and exercise implement 26, perhaps as many as six or more bias members 24, so that the total resistance level of all of the exercise bias members 24 added up to well over one hundred pounds. The leg exerciser would then apply a force of at least one hundred pounds in the exercise force direction FE in order to move the exercise implement 26 during the exercise.

Figure 2:
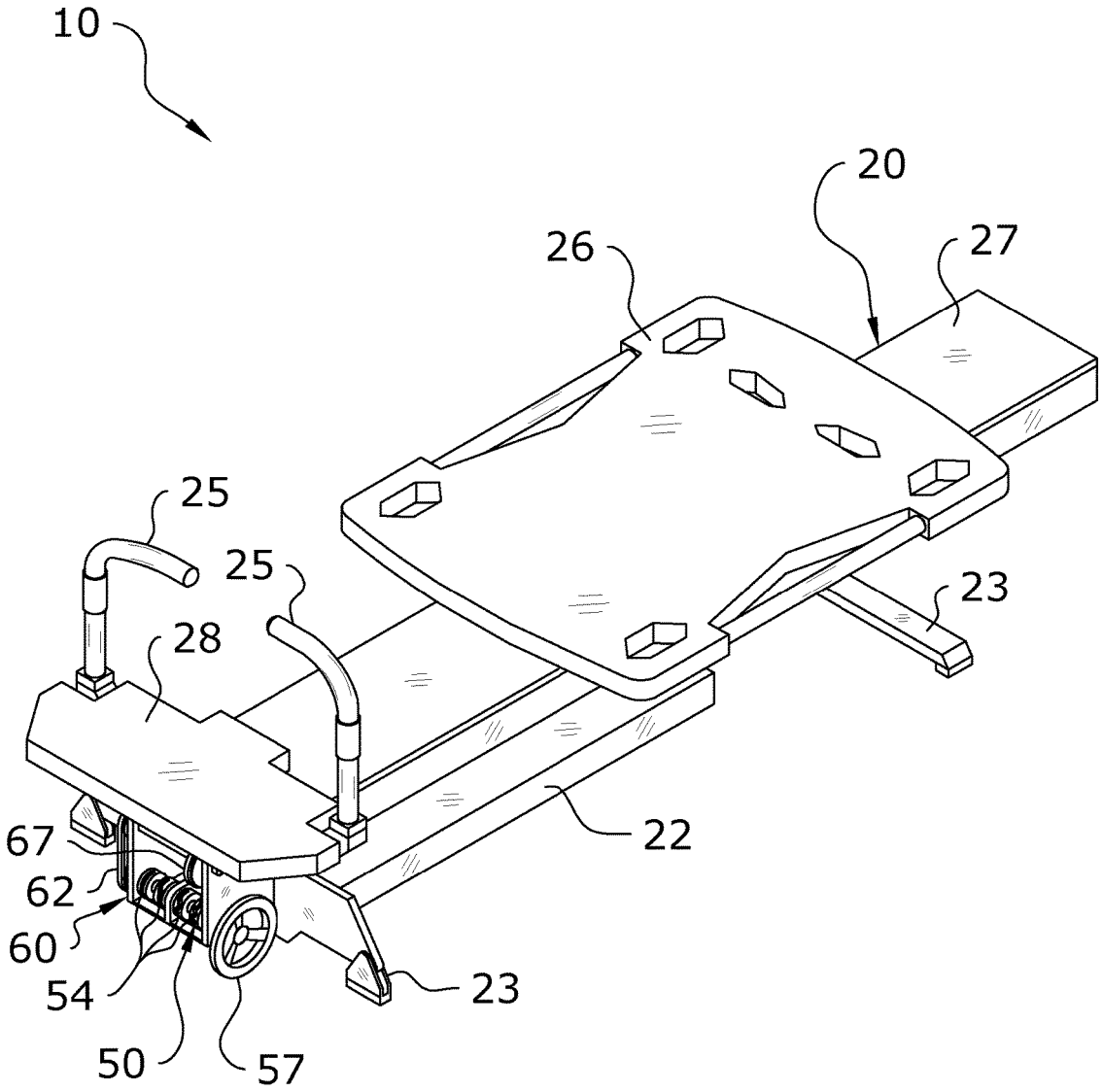
FIG. 2 is an upper perspective view of the present invention.

FIG. 2 is an exemplary diagram showing an upper perspective view of an improved exercise machine 20 comprising a slidable carriage and variable resistance system. More specifically, a substantially longitudinal lower frame 22 is supported by a plurality of support feet 23 resting upon a ground surface or platform. The exercise machine 20 illustrated in FIG. 3 includes a plurality of bias members 39 extending through a hollow cavity of the exercise machine 20, and a pair of parallel rails 27; one being positioned on each side of the frame 22 to retain and support the exercise implement 26. One pair of opposing handles 25 are affixed to the frame 22 and are used by an exerciser to push or pull against during the performance of an exercise, thereby causing the exercise implement 26 to move in a direction towards, or away from, the handles 25. A stationary platform 28 at the head of the exercise machine 20 may be used as a stationary positioning point for an exerciser electing to use the platform 28, rather than the handles 25, for the performance of an exercise.

Most notably, it can be readily seen that no bias members 39 such as springs are exposed to the exerciser, thereby reducing or completely eliminating the possibility of injury being caused by an exerciser becoming entangled in the springs while mounting, dismounting the apparatus, or while attaching or detaching a plurality of bias members 39 between the frame 22 and exercise implement 26. The same principles as discussed herein could also be applied to various other types of exercise machines 20 which utilize exercise bias members 24 and an exercise implement 26.

Still further, as a previously unknown method of changing resistance settings, all of the bias members 39 provided on the improved exercise machine 20 are affixed to resistance pulleys 34 which form part of a plurality of resistance assemblies 33 of the present invention for providing an exerciser quickly and precise selection of the appropriate resistance setting of a predetermined weight by merely rotating a selector handle 57 to one of a plurality of shift increments. Every possible combination of resistance forces may be selected by rotating the selector handle 57 through all discrete increment positions within one 360 degree rotation of the selector handle 57.

It is important to note that although a manually rotatable shift selector handle 57 is shown, the rotation of the actuation shaft 51 may be rotated electrically, for instance by use of a stepper motor 58 programmed by a control unit 59 to stop rotating the actuation shaft 51 at any radial angle corresponding to the engagement or disengagement of any number of bias members 24, thereby providing for rapid precise selection of any resistance level.

Further, one motor 58 or solenoid per shift member 41 could also be used, eliminating the need for the use of shift devices 54. Multiple step setting changes could happen substantially faster because one wouldn't have to move sequentially through the gears.

One of ordinary skill in the art will appreciate that the method and structures used for rotating the actuation shaft 51 just described are not meant to be limiting, and those skilled in the art will appreciate that the methods of rotating the actuation shaft 51 include manual rotation by means of a selector handle 57 or lever, and electromechanically by means of collars 37, motors 58 and mechanical linkages, any of which may be used without deviating from the novelty of the resistance assemblies 33 and actuation assemblies 50 of the present invention.

Figure 3:
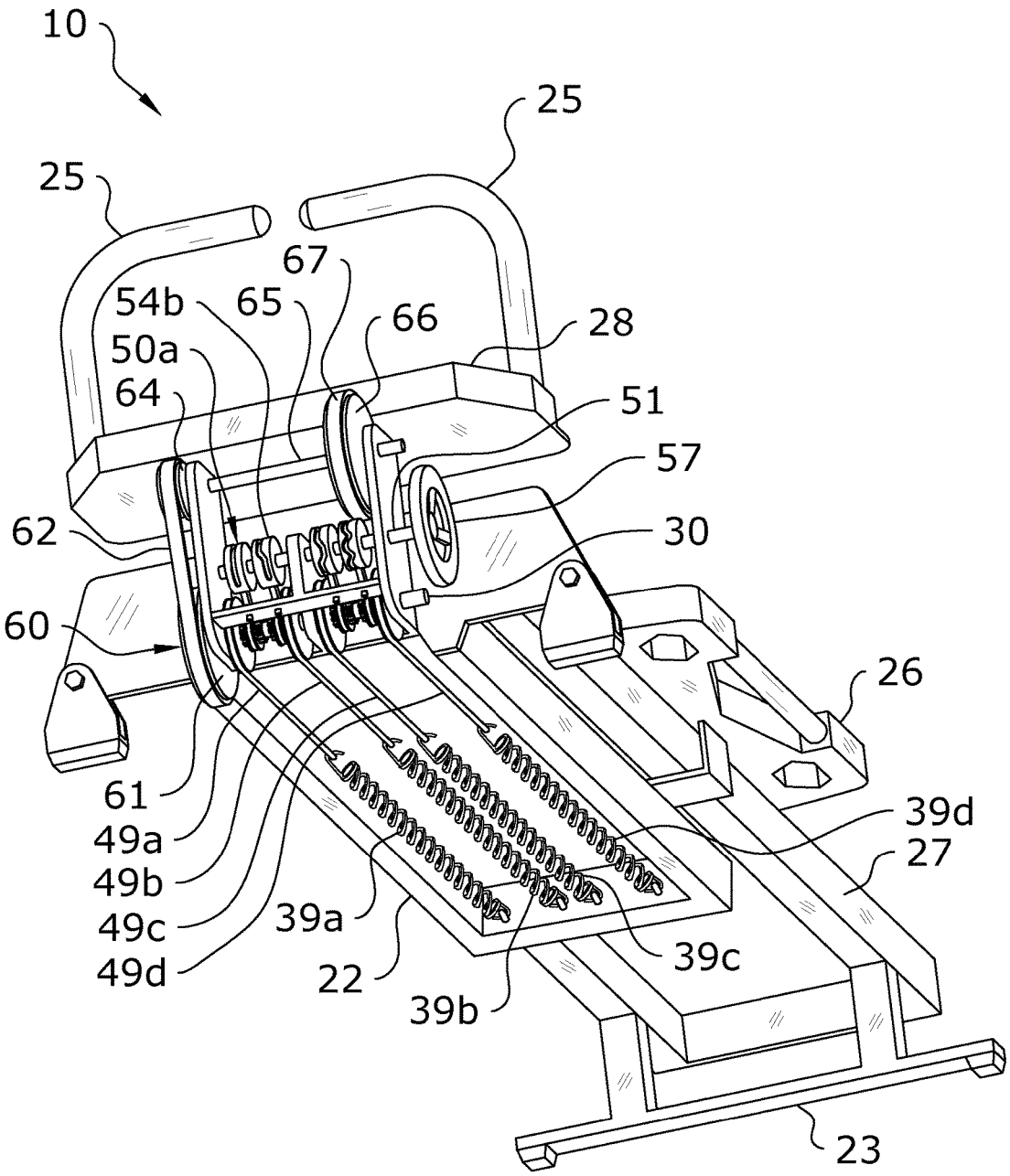
FIG. 3 is a lower perspective view of the present invention.
Figure 4:
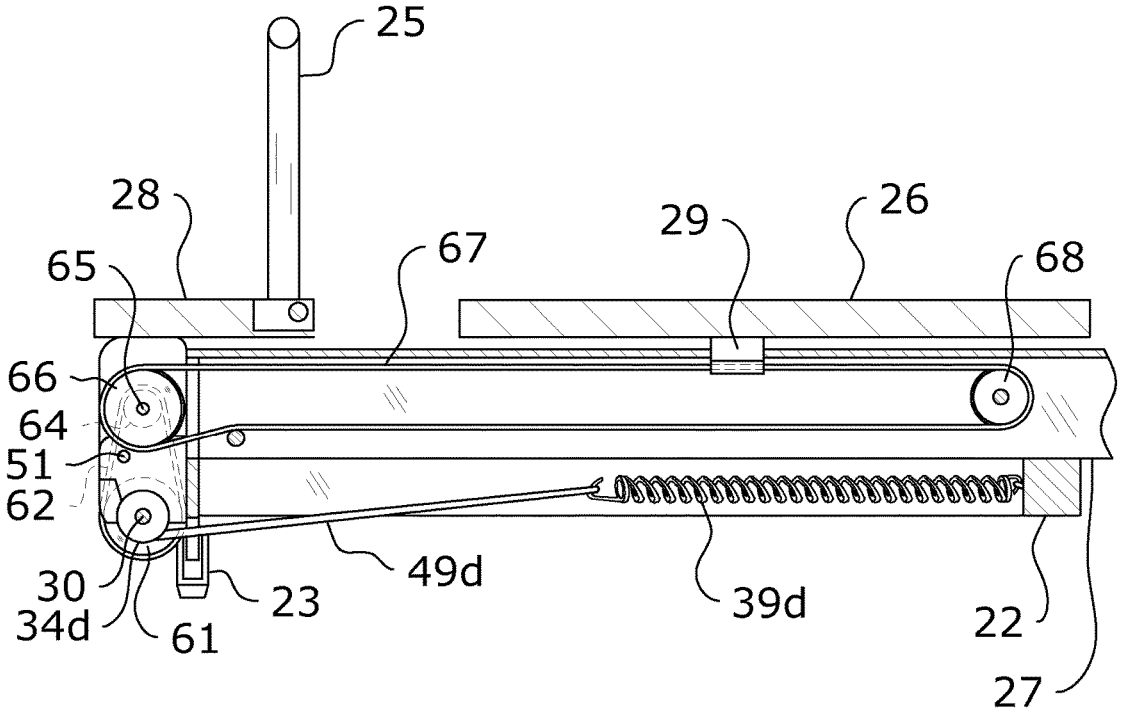
FIG. 4 is a side sectional view of the present invention.

FIG. 3 is an exemplary diagram showing a bottom perspective view of an improved exercise machine 20 comprising a slidable exercise implement 26 and variable resistance system. In the drawing, a plurality of support feet 23 support a substantially longitudinal frame 22 of an exercise machine 20 comprising a rollable exercise implement 26. Rolling wheels not shown roll along a pair of parallel rails 27. The rolling wheels are affixed to the exercise implement 26 by any number of manners. Stationary handles 25 and an optional stationary platform 28 are affixed or removably attached to the frame 22, and are used to support an exerciser upon the exercise machine 20.

A plurality of resistance assemblies 33 can readily be seen secured to the underside of the exercise machine 20, comprising a plurality of bias members 39 of varying resistance levels and configurations. The precise location, resistance levels or number of bias members 39 shown are not meant to be limiting, but illustrate the advantages of enclosing the bias members 39 in a housing to prevent exerciser injury, as well as the advantage of being able to pre-attach all of the bias members 39 with the present invention.

Figure 5:
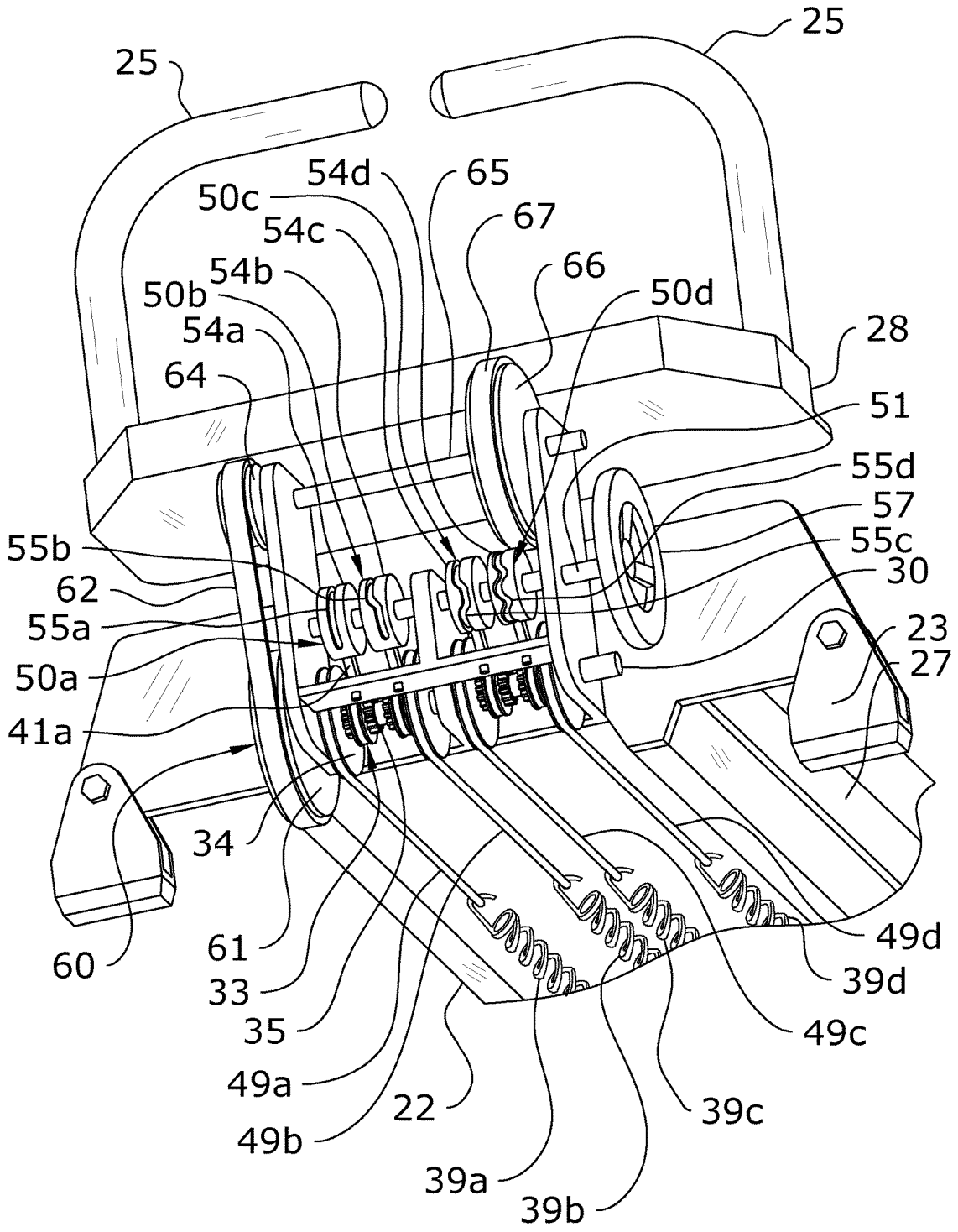
FIG. 5 is a lower perspective view of the variable resistance system of the present invention.

FIG. 5 is an exemplary diagram showing an enlarged view of a portion of FIG. 3 of the improved exercise machine 20 which focuses on the variable resistance system. In the drawing, a variable resistance system comprising a plurality of resistance assemblies 33 and a plurality of actuation assemblies 50 is affixed to a frame 22 and support feet 23. A partial view of the resistance assemblies 33 shows a plurality of bias members 39 of different sizes and resistances, with preferably all of the bias members 39 secured around its own resistance pulley 34. It should be noted that any number of bias members 39 or any preferable length or K-factor may be used, and as can be seen in the drawing, multiple bias members 39 may be connected to a single cable.

The number and sizes of bias members 39 shown in the drawing are for illustrative purposes only, and are not meant to be limiting. Further, the bias members 39 create a resistance force, and any type of bias member 39, including an elastic rope or spring, may be used instead of, or in conjunction with extension springs without diminishing the function or novelty of the present invention. In the alternative, cables 49 may be configured to lift weights, in conjunction with bias members 39, or separately. The figures illustrate four cables 49, separately identified as 49*a*, 49*b*, 49*c*, and 49*d*, though more or less cables 49 may be utilized.

Each of the bias members 39 are attached to a respective resistance pulley 34 of the resistance assemblies 33. As shown in the figures, a plurality of resistance pulleys 34 are installed and freely rotatable on a single splined exercise force main shaft 30 retained on the frame 22 by bearings, bushings, or other such structures.

The present invention utilizes a main connection assembly 60 to connect the resistance assemblies 33 to the exercise implement 26. A main pulley 61 is affixed to the first end 31 of the main shaft 30, and retained thereupon by a friction press fit, a traditional key and set screw, or any other method. A first drive belt 62 is shown wrapping substantially half of the main pulley 61, and further wrapping around an output pulley 64 having been affixed to a drive shaft 65.

The output pulley 64 is of a smaller diameter than the main pulley 61 in order to reduce the rotational ratio of the main shaft 30 relative to the drive shaft 65. It is important to note that to beneficially minimize diameter of the resistance pulleys 34 so that the bias members 39 will not wrap more than one full circumference of the resistance pulley 34 when the exercise implement 26 is moved throughout its maximum range of motion, a main connection assembly 60 with gear reduction is utilized. The gear reduction allows the drive pulley 66 to be a smaller diameter. In the illustrative example, the drive pulley 66 preferably has a total rollout of about 45" while the main shaft 30 preferably spins less than one revolution. Without the gear reduction the drive pulley 66 would otherwise have an objectionable diameter of approximately 17 inches in diameter instead of 6 inches in diameter, as an example.

It should be noted that the main connection assembly 60 is not meant to be limiting, and a reduction gear system that incorporates gears with an idler gear, or a chain may be used instead of the pulley-and-belt system as shown, without deviating from the functionality or novelty of the present invention.

A drive pulley 66 is shown installed on the drive shaft 65. A second drive belt 67 is installed thereupon, and extends to an idler pulley 68 retained at substantially the opposed end of the exercise machine 20. It should be appreciated, however, that the idler pulley 68 may be located at various other locations on the exercise machine 20 and should not be construed as limited by the exemplary figures. The exercise implement 26 is connected to the second drive belt 67 such that movement of the exercise implement 26 is dependent on movement of the second drive belt 67. The main connection assembly 60 is thus adapted to transfer rotational resistance from the resistance assemblies 33 into linear resistance applied to the second drive belt 67.

An actuation assembly 50 comprises a plurality of shifting shift devices 54 having been affixed to an actuation shaft 51 retained by the frame 22 of the present invention. A selector handle 57 affixed to the actuation shaft 51 is rotated to select the engagement or disengagement of one or more resistance pulleys 34 with the main shaft 30, thereby providing for the selection of a precisely defined resistance force at each rotational angle interval to coincide with the number of indexing points within one 360 degree selector handle 57 rotation. As discussed herein, a motor 58 may alternatively be utilized.

Figure 6:
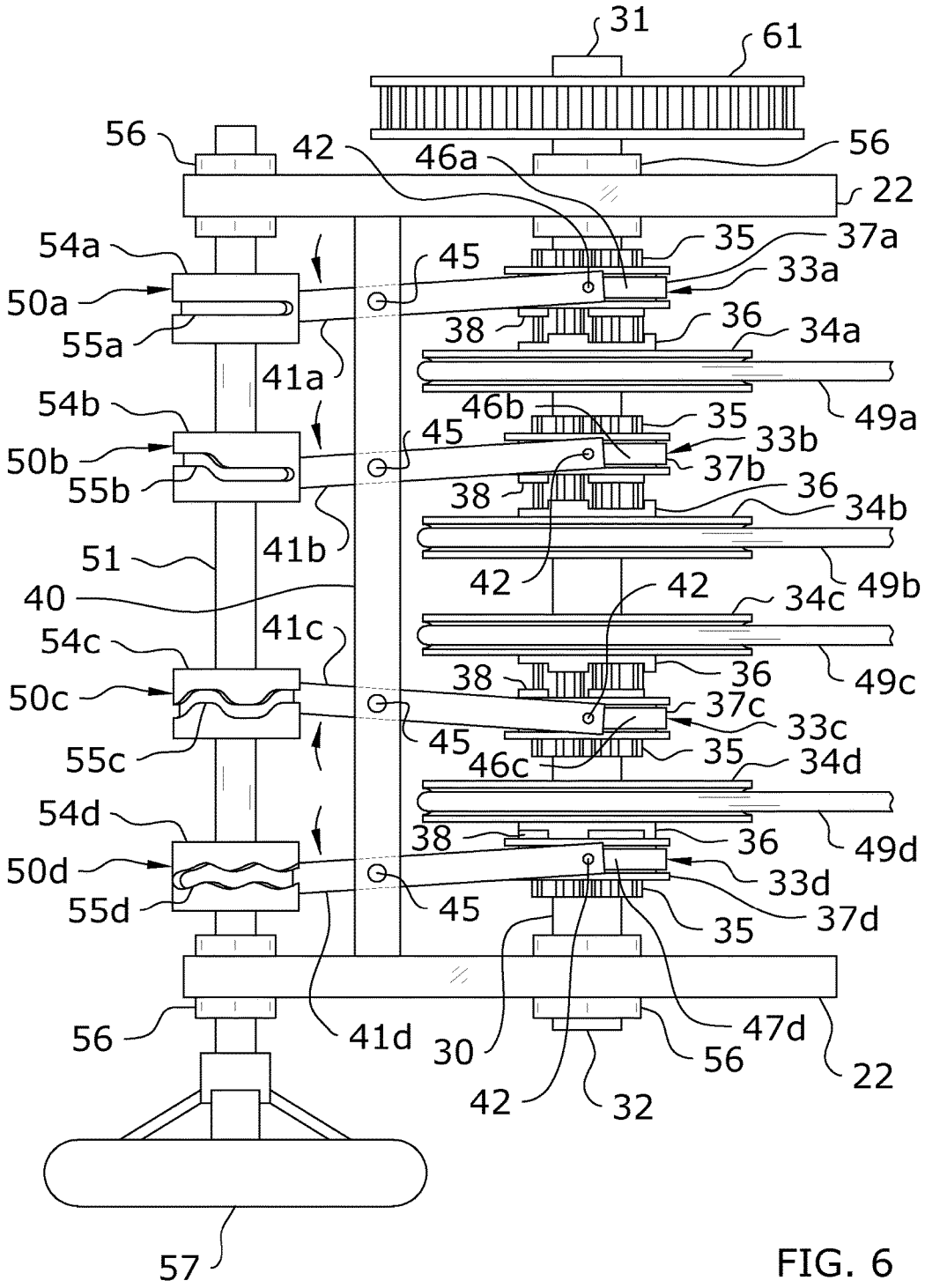
FIG. 6 is a top view of a first embodiment of a variable resistance system of the present invention in which one pulley is engaged.

FIG. 6 is an exemplary diagram showing a top view of a variable resistance system with pivoting shift members 41 of an improved exercise machine 20. In the drawing, a structural support frame 22 is affixed to an exercise machine 20. A main shaft 30 is rotatably secured to the structural frame 22 by any manner, such as bearings 56 or bushings. Preferably, a plurality of spline hubs 35 are affixed to the main shaft 30 so that the spline hubs 35 rotate concurrently with the rotation of the main shaft 30. The resistance pulleys 34 are selectively engaged with the spline hubs 35 such that, when so engaged, the resistance pulleys 34 rotate with the main shaft 30 and, when not engaged, the resistance pulleys 34 freely rotate around the main shaft 30. It should be appreciated that the splines of the spline hubs 35 are preferably located on the exterior surface of the spline hubs 35 as shown in the figures.

The present invention provides for a plurality of resistance pulleys 34; each being associated with one corresponding spline hub 35. The resistance pulleys 34 freely rotate about the main shaft 30 when not engaged by collars 37 or the spline hubs 35. As can be readily seen, one or more first teeth 36 are shown on one side of each of the resistance pulleys 34. A first end of a bias member 39 is affixed to each resistance pulley 34, with a second end of the bias member 39 being terminated elsewhere on the exercise machine 20.

Preferably, the resistance assemblies 33 each include a collar 37 with second teeth 38 into the inside diameter of the collar 37, aligned with the longitudinal axis of the main shaft 30, slidably engages with the radial spline teeth cut into the outside diameter of the corresponding spline hub 35.

Further, a plurality of shift members 41 are pivotally affixed to a shift support 40; the number of shift members 41 corresponding to the number of collars 37. Preferably, engaging members 46 at the first ends 42 of the shift members 41 engage female features on the outside diameter of the collars 37 so that the collars 37 remain rotatable while being retained in position along the main shaft 30. The engaging members 46 may comprise any structure for engaging the collars 37 so that the collars 37 remain rotatable, such as the C-shaped collar shown in the figures. It should be appreciated that the engaging members 46 need not be C-shaped, however, and may fully surround the collars 37 in some embodiments. Rotating the shift members 41 in one direction about their respective pivot pins 45 cause the collars 37 to slide substantially the length of the teeth of the spline hub 35 in the opposed direction.

An actuation shaft 51 is rotatably secured to the frame 22, such as by bearings 56 or bushings. Preferably, a plurality of spaced-apart shift devices 54 (in the figures, four shift devices 54 are shown, though more or less may be utilized), are affixed to the actuation shaft 51 so that the shift devices 54 rotate concurrently with the rotation of the actuation shaft 51. As can readily be seen in the drawings, a cam groove 55 is provided on the outside diameter of each shift device 54, with the geometries of each cam grove 55 differing between the various shift devices 54. As the actuation shaft 51 is rotated, thereby rotating the plurality of shift devices 54, an engagement pin 44 at the second end 43 of each shift member 41 being retained within the cam groove 55 repositions the second end 43 of the shift member 41 in response to the cam groove 55, thereby rotating the shift member 41 about the pivot pin 45. Concurrently, as the second end 43 of the shift member 41 is rotated in one direction, the first end 42 of the shift member 41 repositions the collar 37 towards the resistance pulley 34, and when the shift member 41 is rotated in an opposite direction, the first end 42 of the shift member 41 slides the collar 37 away from its corresponding resistance pulley 34.

Gear teeth 38 are located on the resistance pulley 34 side of each of the collars 37, and are engageable with first teeth 36 on the collar 37 side of each resistance pulley 34. A shift selector handle 57 is affixed to the actuation shaft 51, providing for an exerciser to rotate the selector handle 57 to engage any number, and any combination of collars 37 to the resistance pulleys 34.

Figure 7:
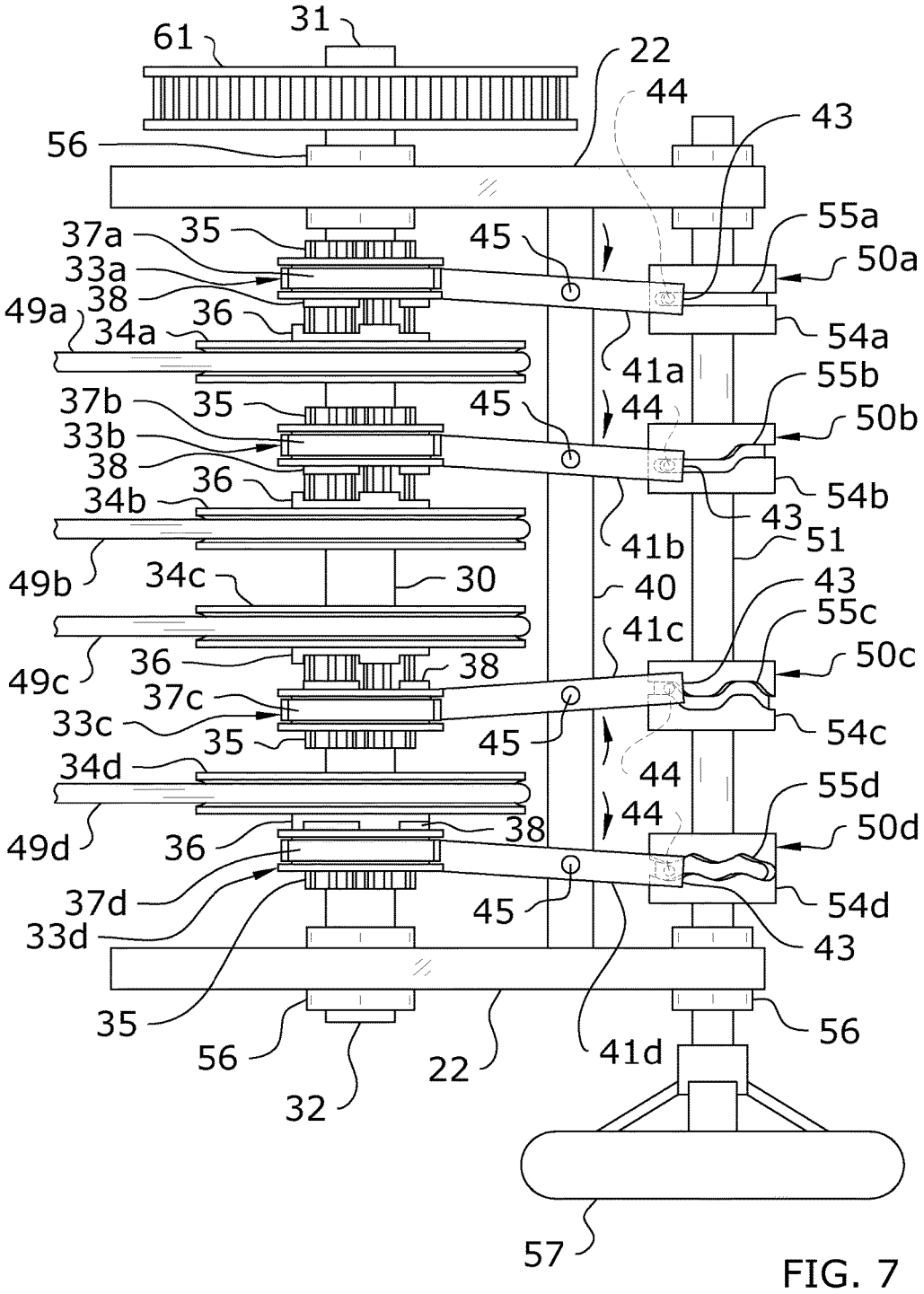
FIG. 7 is a bottom view of a first embodiment of a variable resistance system of the present invention in which one pulley is engaged.

FIGS. 6 and 7 illustrate one resistance configuration. One position of the actuation shaft 51 is shown wherein an engagement pin 44 on a second end 43 of a shift member 41, having engaged the cam groove 55 of the fourth shift device 54 has caused the second teeth 38 of the fourth collar 37 to engage with the first teeth 36 of the fourth resistance pulley 34, thereby "locking up" the fourth collar 37 and fourth resistance pulley 34 (the collar 37 and pulley 34 are engaged).

In this resistance selector shaft position, the first three shift devices 54 have been rotated so that engagement pins 44 on the second ends 43 of the corresponding shift members 41, having engaged their respective cam grooves 55, have caused the second teeth 38 of the first three collars 37 to disengage with the first teeth 36 of their respective resistance pulleys 34, thereby allowing the resistance pulleys 34 to remain stationary as the main shaft 30 is rotated. Thus, the resistance force of the bias members 39 attached to the three disengaged resistance pulleys 34 is not applied to the exercise implement 26.

Figure 8:
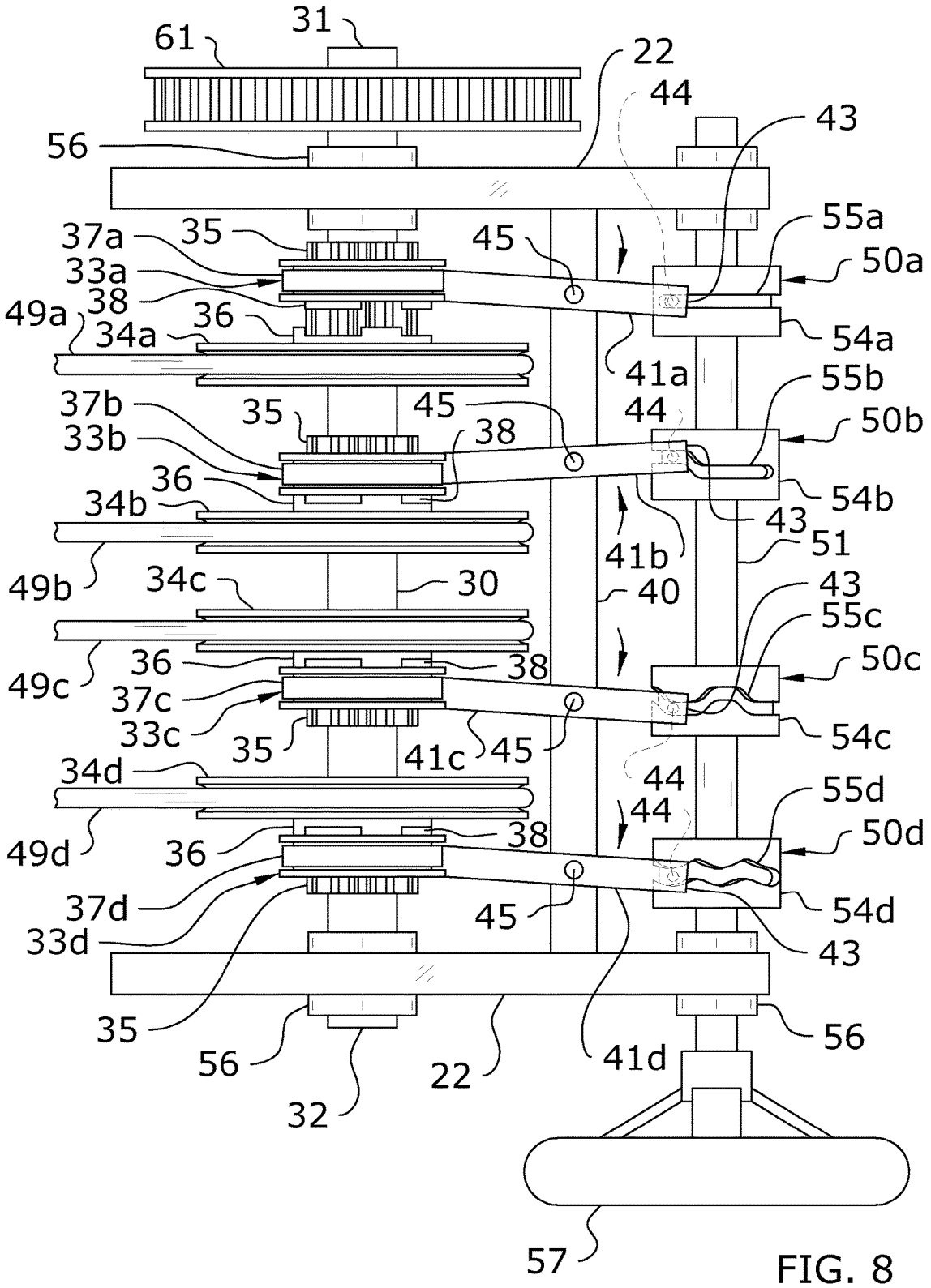
FIG. 8 is a top view of a first embodiment of a variable resistance system of the present invention in which three pulleys are engaged.

FIG. 8 illustrates an alternate configuration in which three resistance pulleys 34 are engaged with three corresponding collars 37 such that resistance from the bias members 39 secured to each of the engaged resistance pulleys 34 is applied to the main shaft 30. The remaining, fourth resistance pulley 34 is disengaged from its corresponding collar 37 and thus does not apply any resistance to the main shaft 30. It should be appreciated that any number of combinations of engaged/disengaged resistance pulleys 34 may be utilized to select various increments of resistance.

Now, with the variable resistance system having been affixed to the improved exercise machine 20 of the present invention, a linear exercise force applied against an exercise implement 26 is converted to a tangential force applied by a drive belt 62 against a main pulley 61. In turn, the main pulley 61 rotates the main shaft 30, and correspondingly only the fourth resistance pulley 34 that has been engaged with the collar 37, effectively locking the otherwise freely rotatable resistance pulley 34 to the main shaft 30.

The linear force applied to the exercise implement 26 is therefore transmitted through the variable resistance system just described; rotating the resistance pulley 34 to extend the bias member 39 when the force transmitted through the resistance transmission system exceeds the resistance value of the bias member 39. It should be appreciated that the bias members 39 of the present invention may include non-biased portions. For example, the bias member 39 may comprise a first non-biased portion (such as a cable 49) which wraps around the resistance pulley 34 and a second biased portion (such as a spring) which extends out from the resistance pulley 34. In some embodiments as shown in the figures, each bias member 39 is connected directly to a corresponding cable 49, with the cable 49 being connected to resistance pulley 34. However, in some embodiments, the bias members 49 themselves may be connected directly to the resistance pulleys 34.

An exerciser may change the resistance level against which they intend to exercise by rotating the selector handle 57 or activating the motor 58 to engage or disengage any number of collars 37 with resistance pulleys 34. It should be noted that the selector handle 57 is rotatable so that every possible combination of resistance pulleys 34 may be engaged within one rotation of the selector handle 57.

It should be further noted that the selector handle 57 is not meant to limit the methods of rotating the main shaft 30, and other mechanical or electromechanical methods and devices may be used. For example, a stepper motor 58 that would precisely rotate the main shaft 30 to each of the many positions where one of the possible combinations of collar 37 engagements with resistance pulleys 34 is realized, or an individually-activated motor 58 or solenoid could be used to actuate a shift member 41.

In embodiments utilizing a motor 58, the motor 58 will similarly be rotatable so that every possible combination of resistance pulleys 34 may be engaged. In some embodiments, a separate control unit 59 may be utilized to control the motor 58. The control unit 59 may comprise a remote control or a computer as shown in the figures. The control unit 59 may be programmed so that an individual need only enter an input resistance and the control unit 59 will rotate the motor 58 to the precise rotation for a specific level of resistance (the resistance being based on the number of engaged resistance pulleys 34).

Figure 9:
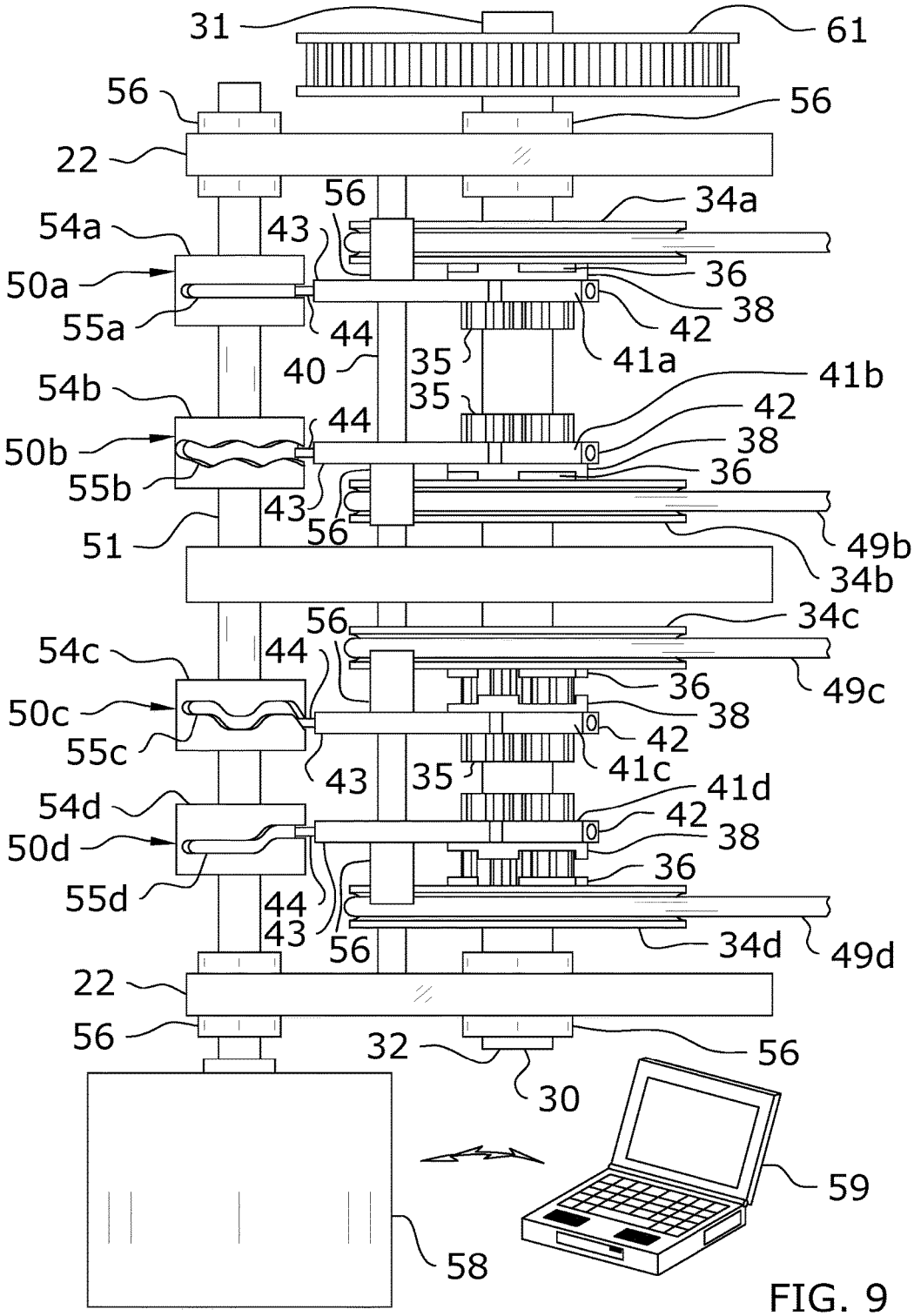
FIG. 9 is a top view of a second embodiment of a variable resistance system of the present invention.

FIG. 9 is an exemplary diagram showing a top view of a variable resistance system of an improved exercise apparatus with shift members 41 which slide instead of pivot. It should be appreciated that, while the figures only show that the shift members 41 may slide or pivot; other movements may be utilized so long as the shift members 41 effectuate the engagement or disengagement of the collars 37 with the resistance pulleys 34 to adjust resistance applied to the exercise implement 26.

More specifically, as a variation of the pivoting shift members 41 of FIG. 5, a plurality of sliding shift members 41 are affixed to a bushing 56 slidable axially along the shift support 40. The sliding shift members 41 retain a collar 37. The shift members 41 are spaced apart on a shift support 40 substantially perpendicular to the shift fork. As can be readily seen in the illustrative example, an engagement pin 44 affixed to the slidable shift member 41 is engaged within the cam groove 55 of the shift device 54.

As the actuation shaft 51 is rotated, thereby rotating the plurality of shift devices 54, the cam grooves 55 of the shift devices 54 move the engagement pin 44, and therefore the sliding shift members 41 toward, or away from their corresponding resistance pulleys 34.

As previously described, as the shift member 41 and collar 37 move toward the resistance pulley 34, the second teeth 38 of the collar 37 engages the first teeth 36 of the resistance pulley 34, thereby rotationally lockably engaging the collar 37 to the resistance pulley 34. The lockably engaged collar 37 and resistance pulley 34 wind the bias member 39 about the resistance pulley 34, thereby pulling the corresponding bias member 39 as an opposing force to the exercise force transmitted from the exercise implement 26 to the main shaft 30.

Figure 10:
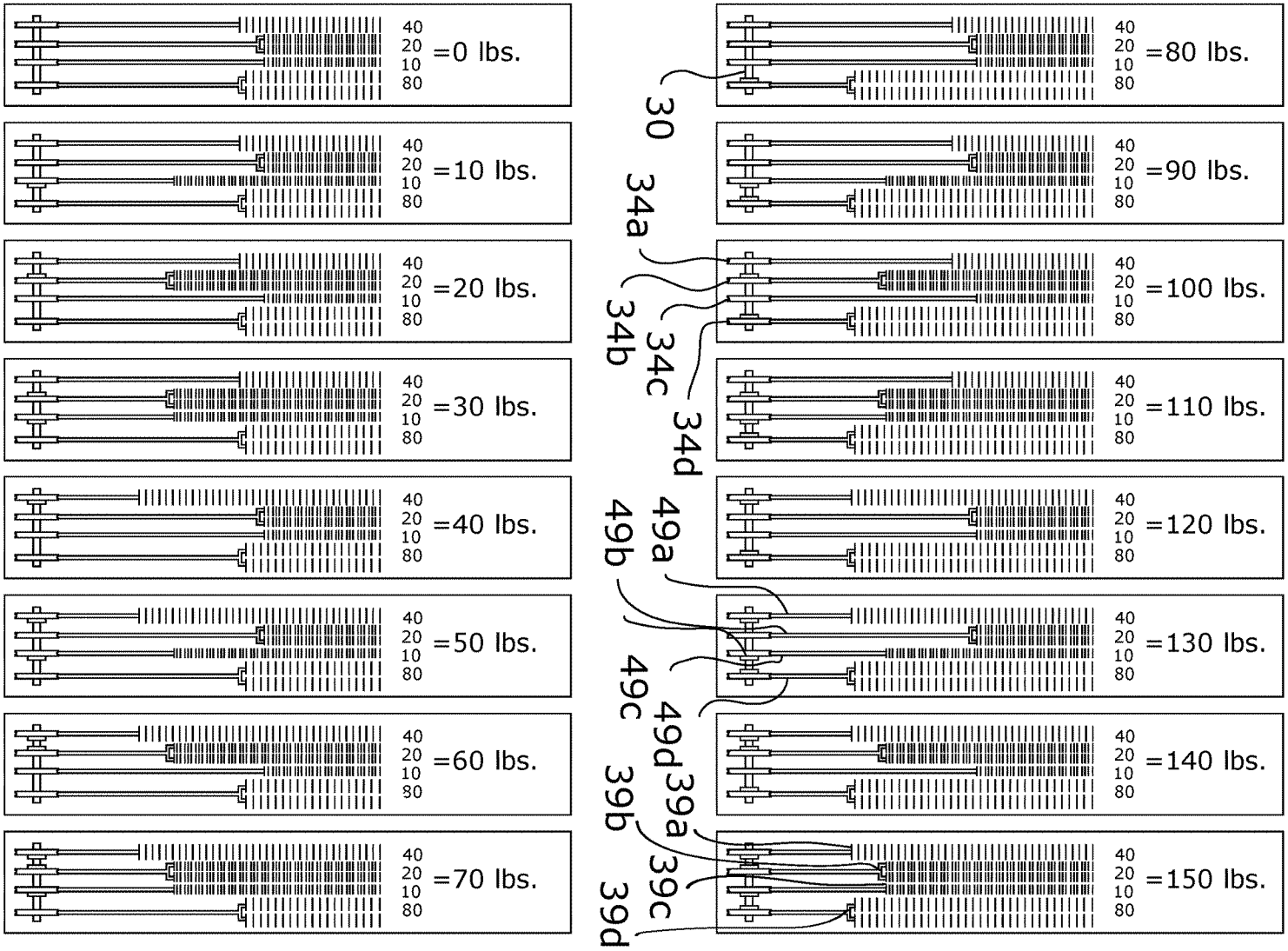
FIG. 10 illustrates various combinations of resistance levels achievable with the resistance assemblies of the present invention.

FIG. 10 is an exemplary diagram showing sixteen possible resistance setting conditions selectable within one axial rotation of the resistance selector handle 57 of an improved exercise machine 20. More specifically, this embodiment of the present invention preferably comprises six bias members 39 in total; three bias members 39 with a first K-factor, and three bias members 39 with a second K-factor four times the first K-factor. For instance, if three bias members 39 delivered a resistance equivalent of ten pounds each, the second set of bias members 39 would deliver a resistance equivalent of forty pounds each.

It should be noted that the embodiment shown is not meant to be limiting, and that any reasonable number of bias members 39 required to deliver any desired number of resistance levels may be used. Although two sets of two of the bias members 39 are connected to one resistance pulley 34 by means of a yoke, one or a plurality of bias members 39 may be connected to any one resistance pulley 34 without limitation. If two or more bias members 39 are connected to one resistance pulley 34, the bias members 39 may be of equal or unequal length, and may be of equal or unequal K-factors.

Further, the four resistance pulleys 34 illustrated in the diagram are not meant to be limiting. In other words, while the preferable configuration of the variable resistance system comprises four sets of resistance assemblies 33 and actuation assemblies 50, the number of resistance assemblies 33 and actuation assemblies 50 of an improved exercise machine 20 is not limited to four, and may be more or less depending on the number of increments, and the magnitude of each weight increment desired for each type of exercise equipment.

Those skilled in the art will appreciate that each of the sixteen conditions shown represent sixteen different combinations of engaging four resistance pulleys 34 in such a manner as to increase or decrease the weight equivalent of the bias members 39 from zero, to 150 lbs. in equal, sequential increments. Although weight increments of ten pounds are described, increments may be of any desired weight, and increments may be of equal or dissimilar magnitude between each indexed position of the selector handle 57, or the weight increment may increase or decrease at a variable rate between each indexed position. The novel variable resistance system of the present invention is not limited by spring K-factors, a requirement to maintain equal weight increments between each indexed position, or the number of weight increments, In the drawing, a first transmission setting condition shows four resistance pulleys 34 interconnected by a main shaft 30 of a complete variable resistance system. A first resistance pulley 34 is affixed to a first bias member 39. A bias member 39 with a resistance K-factor of 40 pounds is shown merely for illustrative purposes, and is not limited to 40 pounds.

A second resistance pulley 34 is affixed to a second and third bias member 39 by a yoke so that both bias members 39 are pulled equally in response to rotation of the second resistance pulley 34. Two bias members 39, each with a resistance K-factor of ten pounds is shown merely for illustrative purposes, and is not limited to ten pounds.

A third resistance pulley 34 is affixed to a fourth bias member 39. A bias member 39 with a resistance K-factor of ten pounds is shown merely for illustrative purposes, and is not limited to ten pounds.

A fourth resistance pulley 34 is affixed to a fifth and sixth bias member 39 by a yoke so that both bias members 39 are pulled equally in response to rotation of the fourth resistance pulley 34. Two bias members 39, each with a resistance K-factor of forty pounds is shown merely for illustrative purposes, and is not limited to forty pounds.

As previously described, each resistance pulley 34 is an exercise force output pulley that counteracts an exercise input force by means of the resistance level of the attached bias members 39. Each force resistance pulley 34 is engaged or disengaged from the main shaft 30 by a shifting shift device 54.

In the first condition, none of the resistance pulleys 34 have been engaged to the main shaft 30, therefore no resistance forces have been engaged to counteract against an exercise input force on the exercise implement 26. The "zero" resistance condition will allow an exerciser to freely move the exercise implement 26 in either longitudinal direction without encountering any resistance.

An exerciser may elect to apply a force greater than ten pounds to the exercise implement 26 as a workout weight. A second condition is established by rotating a selector handle 57 (or by activating the motor 58) to a first increment, thereby rotating the actuation shaft 51 and shift devices 54 so that only the shift member 41 engaging the collar 37 of the highlighted third output resistance pulley 34 connected to bias members 39 with a ten pound resistance level is engaged.

A third condition to create a twenty pound workout resistance is established by rotating a selector handle 57 further to a second increment, thereby rotating the actuation shaft 51 and shift devices 54 so that only the shift member 41 engaging the collar 37 of the highlighted second output resistance pulley 34 connected by a yoke to two bias members 39, each with a ten pound resistance level, is engaged.

Further, if a higher weight workout resistance level of 110 lbs. is desired, the selector handle 57 is rotated to a forth transmission setting condition, also shown as the twelfth index, so that three of the shift devices 54 actuate three of the shift members 41, and correspondingly the collars 37 of the highlighted second, third and fourth output resistance pulleys 34 connected to a plurality of bias members 39; together which total 110 lbs.

Still further, if the maximum weight workout resistance level of 150 lbs. is desired, the selector handle 57 is rotated to a fifth transmission setting condition, also the sixteenth index position, so that all four of the shift devices 54 actuate all of the shift members 41, and correspondingly all of the collars 37 of all resistance pulleys 34 connected to all available bias members 39, together which total 150 lbs.

It should be noted that if equal fifteen pound increments are desired, bias members 39 of fifteen and sixty pounds would be used instead of the ten and forty pound bias members 39 shown in the illustration. Fifteen pound increments would result in a maximum exercise machine resistance weight capacity of 225 lbs. Therefore, it can be readily understood that the maximum weight equivalent of the bias members 39, and therefore the maximum exercise machine 20 capacity is limited only by the size, cost and intended use, and that varying the weight increments or total incremental weight does not deviate from the functionality and novelty taught by the present invention.

In use, an exerciser will perform an initial setup of the present invention prior to beginning a workout using the exercise implement 26. The exerciser will thus utilize the actuation assemblies 50, and more specifically the selector handle 57 or motor 58 of the actuation assemblies 50, to set an initial resistance level for the beginning of her workout. The selector handle 57 may be rotated to reach an initial resistance level which is desired by the exerciser. Alternatively, a motor 58 may be activated, such as through use of a control unit 59, to similarly adjust resistance.

In any case, rotation of the actuation shaft 51 by either the selector handle 57 or the motor 58 will cause various combinations of resistance assemblies 33 to engage or disengage with a main shaft 30. The number of resistance assemblies 33 so engaged or disengaged with the main shaft 30 will determine the level of resistance applied against movement of the exercise implement 26 by limiting or not limiting rotation of the main shaft 30. Rotation force of the main shaft 30 is applied via the main connection assembly 60 to the exercise implement 26.

With an initial resistance level selected, the exerciser may begin their workout by mounting the exercise machine 20 and using the exercise implement 26 to exercise various muscle groups. For example, one may exercise a wide range of muscle groups on exercise machines 20 comprised of a Pilates machine, wherein the exercise implement 26 comprises a movable carriage mounted to rails 27, with the movable carriage receiving resistance from the engaged resistance assemblies 33. In an embodiment such as FIG. 11, a wide range of muscle groups may be exercised by lifting or lowering an exercise implement 26 comprised of a squat bar, with the squat bar receiving resistance from the engaged resistance assemblies 33. In any case, the level of workout intensity will be directly related to the resistance applied against the exercise implement 26; the applied resistance being a function of the number of resistance assemblies 33 which are engaged or disengaged by the actuation assemblies 50.

After completing an initial workout at a first level of resistance, the exerciser may want to adjust resistance to complete additional workouts. For example, the exerciser may want to focus on a second muscle group which they have already developed to a point that requires more resistance than that which was applied to the first muscle group at the first level of resistance to effectuate a workout of that second muscle group. Alternatively, an exerciser may wish to perform an initial "warm-up" workout at a first resistance level and then continue with incrementally high levels of resistance to "ramp up" the workout intensity. Similarly, the exerciser may perform a "cool-down" workout during later stages of their exercise routine by incrementally lowering levels of resistance through the same methods. Lowering resistance levels may be performed by continuing rotation of the actuation assemblies 50 until the proper number of resistance assemblies 33 are engaged or disengaged, thus affecting the level of resistance applied to the exercise implement 26.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise machine with variable resistance system, comprising:

a frame;

an exercise implement movably connected to said frame;

a main shaft rotatably connected to said frame;

a main connector attached between said main shaft and said exercise implement;

a plurality of resistance assemblies, wherein each of said plurality of resistance assemblies includes a bias member adapted to exert a resistance force against rotation of said main shaft in a first rotational direction, wherein each of said plurality of resistance assemblies is selectively rotationally locked with said main shaft or rotationally unlocked with said main shaft;

and a plurality of actuation assemblies, wherein each of said plurality of actuation assemblies are adapted for selectively rotationally locking and unlocking at least one of said plurality of resistance assemblies with respect to said main shaft, wherein said plurality of resistance assemblies apply a total level of rotational resistance against said main shaft based on which of said plurality of resistance assemblies are rotationally locked with said main shaft by said plurality of actuation assemblies;

wherein each of said plurality of resistance assemblies includes a clutch;

wherein each of said plurality of actuation assemblies includes a shift member having pivoting or sliding motion longitudinally along the main shaft to connect to said clutch for engaging or disengaging said clutch to selectively rotationally lock or unlock each of said plurality of resistance assemblies with respect to said main shaft.

2. The exercise machine with variable resistance system of claim 1, wherein each of said plurality of resistance assemblies comprises a pulley rotatably positioned upon said main shaft and wherein said pulley is connected to said bias member.

3. The exercise machine with variable resistance system of claim 2, wherein said clutch selectively engages said pulley to selectively rotationally lock or unlock said pulley with respect to said main shaft.

4. The exercise machine with variable resistance system of claim 3, wherein said pulley is connected to said main shaft in a non-rotating manner with respect to said main shaft when said pulley is in a locked state with respect to said main shaft, and wherein said pulley is not connected to said main shaft so as to allow for free rotation of said pulley with respect to said main shaft when said pulley is in an unlocked state with respect to said main shaft.

5. The exercise machine with variable resistance system of claim 1, wherein said shift member is comprised of an elongated member, wherein said shift member includes a first end connected to one of said plurality of resistance assemblies and a second end connected to said actuation assembly.

6. The exercise machine with variable resistance system of claim 5, wherein each of said plurality of actuation assemblies include a shift device attached to an actuation shaft, wherein said second end of said shift member engages said shift device.

7. The exercise machine with variable resistance system of claim 6, wherein said shift device includes a cam groove that is engaged by said second end of said shift member.

8. The exercise machine with variable resistance system of claim 6, comprising a handle for rotating said actuation shaft.

9. The exercise machine with variable resistance system of claim 6, comprising a motor for rotating said actuation shaft.

10. The exercise machine with variable resistance system of claim 1, wherein said clutch is comprised of a non-slip clutch.

11. The exercise machine with variable resistance system of claim 10, wherein said clutch is comprised of a dog clutch.

12. The exercise machine with variable resistance system of claim 1, wherein said clutch is engaged or disengaged by one of said plurality of actuation assemblies.

13. The exercise machine with variable resistance system of claim 1, wherein each of said plurality of resistance assemblies is selectively rotationally locked or unlocked with said main shaft by said clutch to adjust said total level of rotational resistance against said main shaft.

14. The exercise machine with variable resistance system of claim 1, wherein each of said plurality of actuation assemblies is comprised of an electric actuator.

15. An exercise machine with variable resistance system, comprising:

a frame;

an exercise implement movably connected to said frame, wherein said exercise implement is comprised of a carriage movable between a first end of said frame and a second end of said frame;

a main shaft rotatably connected to said frame;

a main connector attached between said main shaft and said exercise implement;

a plurality of resistance assemblies, wherein each of said plurality of resistance assemblies includes a bias member adapted to exert a resistance force against rotation of said main shaft in a first rotational direction, wherein each of said plurality of resistance assemblies is selectively rotationally locked with said main shaft or rotationally unlocked with said main shaft;

and a plurality of actuation assemblies, wherein each of said plurality of actuation assemblies are adapted for selectively rotationally locking and unlocking at least one of said plurality of resistance assemblies with respect to said main shaft, wherein said plurality of resistance assemblies apply a total level of rotational resistance against said main shaft based on which of said plurality of resistance assemblies are rotationally locked with said main shaft by said plurality of actuation assemblies;

wherein each of said plurality of resistance assemblies includes a clutch;

wherein each of said plurality of actuation assemblies includes a shift member having pivoting or sliding motion longitudinally along the main shaft to connect to said clutch for engaging or disengaging said clutch to selectively rotationally lock or unlock each of said plurality of resistance assemblies with respect to said main shaft, wherein said clutch is engaged or disengaged by one of said plurality of actuation assemblies;

wherein each of said plurality of resistance assemblies comprises a pulley rotatably positioned upon said main shaft and wherein said pulley is connected to said bias member, wherein said clutch selectively engages said pulley to selectively rotationally lock or unlock said pulley with respect to said main shaft.

16. The exercise machine with variable resistance system of claim 15, wherein said pulley is connected to said main shaft in a non-rotating manner with respect to said main shaft when said pulley is in a locked state with respect to said main shaft, and wherein said pulley is not connected to said main shaft so as to allow for free rotation of said pulley with respect to said main shaft when said pulley is in an unlocked state with respect to said main shaft.

17. The exercise machine with variable resistance system of claim 15, wherein said clutch is comprised of a non-slip clutch.

* * * * *